US011159875B2

(12) United States Patent
Kosaka et al.

(10) Patent No.: US 11,159,875 B2
(45) Date of Patent: Oct. 26, 2021

(54) AUDIO OUTPUT APPARATUS

(71) Applicant: SONY CORPORATION, Tokyo (JP)

(72) Inventors: Mayu Kosaka, Kanagawa (JP); Taku Yaegashi, Tokyo (JP); Sai Karasawa, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/981,403

(22) PCT Filed: Jan. 30, 2019

(86) PCT No.: PCT/JP2019/003157
§ 371 (c)(1),
(2) Date: Sep. 16, 2020

(87) PCT Pub. No.: WO2019/187610
PCT Pub. Date: Mar. 10, 2019

(65) Prior Publication Data

US 2021/0014594 A1 Jan. 14, 2021

(30) Foreign Application Priority Data

Mar. 26, 2018 (JP) ..... JP2018-058139

(51) Int. Cl.
*H04R 1/10* (2006.01)
*H04R 1/08* (2006.01)

(52) U.S. Cl.
CPC ..... *H04R 1/105* (2013.01); *H04R 1/08* (2013.01); *H04R 1/1016* (2013.01);
(Continued)

(58) Field of Classification Search
CPC ..... H04R 1/105; H04R 1/08; H04R 1/1016; H04R 1/1041; H04R 1/1075
See application file for complete search history.

(56) References Cited

U.S. PATENT DOCUMENTS 8,061,473 B1 * 11/2011 Kerr ..... A61F 11/008 181/135
2009/0185706 A1 * 7/2009 Ito ..... H04R 1/1066 381/382

(Continued)

FOREIGN PATENT DOCUMENTS

CN 101322434 A 12/2008
EP 1943875 A1 7/2008

(Continued)

OTHER PUBLICATIONS

International Search Report and Written Opinion of PCT Application No. PCT/JP2019/003157, dated Apr. 2, 2019, 07 pages of ISRWO.

(Continued)

*Primary Examiner* — Simon King
(74) *Attorney, Agent, or Firm* — Chip Law Group

(57) ABSTRACT

An audio output apparatus has a simplified structure and is stably fitted in an ear assuredly. The audio output apparatus includes: a speaker that outputs a sound; a base body that includes a facing surface and is at least partially inserted into an ear canal of an ear; a rotating body that includes a relative surface at least partially facing the facing surface and is rotatable relative to the base body; and a fulcrum shaft that is present at least at one of a position displaced from a middle portion of the facing surface or a position displaced from a middle portion of the relative surface, the fulcrum shaft serving as a fulcrum of rotation of the rotating body relative to the base body, in which, in a state where the base body is inserted into the ear canal, the rotating body rotated relative to the base body is allowed to be in contact with part of the ear.

18 Claims, 26 Drawing Sheets

(52) U.S. Cl.
CPC ..... *H04R 1/1041* (2013.01); *H04R 1/1075* (2013.01); *H04R 2420/07* (2013.01)

(56) References Cited

U.S. PATENT DOCUMENTS

| | | | | |
|---|---|---|---|---|
| 2010/0002897 | A1* | 1/2010 | Keady | A61F 11/10 381/328 |
| 2010/0074462 | A1 | 3/2010 | Lee et al. | |
| 2010/0124349 | A1* | 5/2010 | Bass | H04R 1/10 381/379 |
| 2017/0095165 | A1* | 4/2017 | Hirano | H04R 1/1016 |

FOREIGN PATENT DOCUMENTS

| | | | |
|---|---|---|---|
| JP | 04-199999 | A | 7/1992 |
| JP | 07-050892 | A | 2/1995 |
| JP | 2010-200074 | A | 9/2010 |
| JP | 2015-076856 | A | 4/2015 |
| KR | 10-2006-0113603 | A | 11/2006 |
| WO | 2008/044819 | A1 | 4/2008 |
| WO | 2014/162407 | A1 | 10/2014 |

OTHER PUBLICATIONS

Extended European Search Report of EP Application No. 19777869.9, dated Apr. 6, 2021, 08 pages.

* cited by examiner

AUDIO OUTPUT APPARATUS

CROSS REFERENCE TO RELATED APPLICATIONS

This application is a U.S. National Phase of International Patent Application No. PCT/JP2019/003157 filed on Jan. 30, 2019, which claims priority benefit of Japanese Patent Application No. JP 2018-058139 filed in the Japan Patent Office on Mar. 26, 2018. Each of the above-referenced applications is hereby incorporated herein by reference in its entirety.

TECHNICAL FIELD

The present technology relates to a technical field of an audio output apparatus equipped with a speaker that outputs sounds.

BACKGROUND ART

There is provided an audio output apparatus that is worn on the head and used as headphones or earphones to output sounds from a speaker. Such audio output apparatuses have been increasingly used in a mode of being used outdoors in addition to a mode of being used indoors. Inside the audio output apparatus, a speaker that outputs sounds, a control board that controls driving of devices such as the speaker, and the like are placed.

Some of such audio output apparatuses include a movable member rotatable relative to the housing in which a speaker and the like are placed (see Patent Document 1).

In the audio output apparatus described in Patent Document 1, the housing body and the front cap are coupled together to form a housing, and the movable member is rotatable relative to the housing while being supported in a position straddling the housing body and the front cap. The movable member is configured such that a protruding portion is disposed on the movable member and the protruding portion is insertable into the cavity of concha of the ear.

In the audio output apparatus described in Patent Document 1, contact of the protruding portion with the ear is adjusted in accordance with the rotational position of the movable member relative to the housing, so that the feeling of fitting the audio output apparatus in the ear can be changed. For example, when the protruding portion is in contact with part of the ear, such as the antihelix, a stronger feeling of fitting is felt, whereas when the protruding portion is positioned away from part of the ear, a feeling of fitting with less pressure is felt.

CITATION LIST

Patent Document

Patent Document 1: Japanese Patent Application Laid-Open No. H7-50892

SUMMARY OF THE INVENTION

Problems to be Solved by the Invention

Meanwhile, in the audio output apparatus 1 described in Patent Document 1, the movable member is rotatable relative to the housing while being supported in a position straddling the housing body and the front cap, which may require a complicated structure.

In addition, an audio output apparatus like the apparatus described above is desired to provide a stable fitting state while being fitted in the ear.

Therefore, an object of an audio output apparatus of the present technology is to overcome the above-described problem by simplifying the structure of the apparatus and ensuring that the apparatus is stably fitted in the ear.

Solutions to Problems

First, an audio output apparatus according to the present technology includes: a speaker that outputs a sound; a base body that includes a facing surface and is at least partially inserted into an ear canal of an ear; a rotating body that includes a relative surface at least partially facing the facing surface and is rotatable relative to the base body; and a fulcrum shaft that is present at least at one of a position displaced from a middle portion of the facing surface or a position displaced from a middle portion of the relative surface, the fulcrum shaft serving as a fulcrum of rotation of the rotating body relative to the base body, in which, in a state where the base body is inserted into the ear canal, the rotating body rotated relative to the base body is allowed to be in contact with part of the ear.

Therefore, the rotating body is rotated relative to the base body inserted into the ear canal on a position displaced from a middle portion of the facing surface or the relative surface, whereby the rotating body comes into contact with part of the ear.

Second, in the audio output apparatus, it is desirable that the rotating body rotated relative to the base body is at least partially inserted into a cavity of concha.

Therefore, the audio output apparatus is fitted in the ear in a state where the base body is in contact with the opening edge of the ear canal and the rotating body is at least partially inserted into the cavity of concha.

Third, in the audio output apparatus, it is desirable that the rotating body rotated relative to the base body is at least partially brought into contact with an antihelix or an inferior crus of antihelix.

Therefore, the audio output apparatus is fitted in the ear in a state where the base body is in contact with the opening edge of the ear canal and the rotating body is at least partially in contact with the antihelix or the inferior crus of antihelix.

Fourth, in the audio output apparatus, it is desirable that: the base body includes an outer circumferential surface that is a surface of revolution formed by being rotated with respect to a central axis; the facing surface and the relative surface are inclined with respect to a plane orthogonal to the central axis; and an axial direction of the fulcrum shaft is along a direction orthogonal to the facing surface.

Therefore, the facing surface and the relative surface are inclined with respect to the central axis and the axial direction of the fulcrum shaft is orthogonal to the facing surface.

Fifth, in the audio output apparatus, it is desirable that the facing surface and the relative surface are in surface contact with each other.

Therefore, there is no gap between the facing surface and the relative surface.

Sixth, in the audio output apparatus, it is desirable that: a microphone is placed inside the base body; and a sound input hole intended for inputting a sound to the microphone is formed in a portion in the base body, the portion facing the relative surface.

Therefore, the sound input hole is opened or closed in accordance with the rotation of the rotating body relative to the base body.

Seventh, in the audio output apparatus, it is desirable that: the rotating body includes a circumferential surface whose one end is continuous with an outer periphery of the relative surface; and the circumferential surface is formed into a curved surface.

Therefore, when the rotating body is rotated relative to the base body, the circumferential surface formed into a curved surface is brought into contact with, and pressed against, part of the ear.

Eighth, in the audio output apparatus, it is desirable that the base body is formed in a tapered shape whose outer circumference becomes smaller as the base body is farther away from the rotating body.

Therefore, the base body is inserted into the ear canal and brought into contact with the opening edge of the ear canal without regard to the size of the ear canal.

Ninth, in the audio output apparatus, it is desirable that the base body is formed in a substantially conical shape.

Therefore, the base body is inserted into the ear canal and brought into contact with the opening edge of the ear canal without regard to the size of the ear canal.

Tenth, in the audio output apparatus, it is desirable that an outer surface of a tip side portion of the base body is formed in a curved shape convex toward the tip side.

Therefore, the base body is inserted into the ear canal from the tip side portion formed in a curved shape convex toward the tip side.

Eleventh, in the audio output apparatus, it is desirable that: the base body includes an enclosure and an earpiece, the enclosure including a placement space that is formed inside the enclosure, the earpiece being in close contact with at least part of an outer surface of the enclosure; and the earpiece includes an elastically deformable material.

Therefore, the elastically deformable earpiece is brought into contact with the opening edge of the ear canal.

Twelfth, in the audio output apparatus, it is desirable that: the earpiece includes a tip portion and an outer circumferential portion, the tip portion including a sound output hole that is formed in the earpiece, the outer circumferential portion being continuous with the tip portion and being formed to be tubular; and a thickness of the tip portion is greater than the thickness of the outer circumferential portion.

Therefore, the enclosure located inside the earpiece is enabled to have a larger placement space.

Thirteenth, in the audio output apparatus, it is desirable that the rotating body is rotatable relative to the base body in opposite directions.

Therefore, the user is allowed to select a rotation direction to rotate the rotating body.

Fourteenth, in the audio output apparatus, it is desirable that: a battery being substantially cylindrical and a control board to which power is supplied from the battery are placed inside the rotating body; and an axial direction of the battery and an orientation of the control board coincide with a direction along which the base body and the rotating body are arranged.

Therefore, both the thickness direction of the battery and the thickness direction of the control board coincide with the direction along which the base body and the rotating body are arranged.

Fifteenth, in the audio output apparatus, it is desirable that the battery and the control board are positioned to face each other.

Therefore, the battery and the control board are positioned side by side in the direction along which the base body and the rotating body are arranged.

Sixteenth, in the audio output apparatus, it is desirable that an antenna that transmits and receives a signal is disposed.

Therefore, the need for connecting a cable for transmitting and receiving a signal to and from an external device is eliminated.

Seventeenth, in the audio output apparatus, it is desirable that: a connection line that is partially positioned inside the base body and partially positioned inside the rotating body and is configured to supply at least power is disposed; the fulcrum shaft is formed to be tubular; and the connection line is partially inserted through the fulcrum shaft.

Therefore, a portion placed inside the base body and a portion placed inside the rotating body are allowed to be connected by the connection line partially inserted through the fulcrum shaft.

Eighteenth, in the audio output apparatus, it is desirable that a length of the fulcrum shaft along an axial direction is variable.

Therefore, the length of the fulcrum shaft can be changed to change the distance between the base body and the rotating body.

Effects of the Invention

According to the present technology, the rotating body is rotated relative to the base body inserted into the ear canal on a fulcrum at a position displaced from a middle portion of the facing surface or the relative surface, and resultingly the rotating body is brought into contact with part of the ear. Therefore, it is made possible to simplify the structure of the audio output apparatus and ensure that the audio output apparatus is stably fitted in the ear.

Note that the effects described herein are examples only and are not restrictive, and other effects may be provided.

BRIEF DESCRIPTION OF DRAWINGS

FIG. 1 is a perspective view of an ear in which the audio output apparatus is to be fitted.

FIG. 23 is a front view showing an example in which the facing surface is orthogonal to the central axis and the axial direction of the fulcrum shaft is orthogonal to the facing surface.

MODE FOR CARRYING OUT THE INVENTION

Embodiments of an audio output apparatus of the present technology will now be described with reference to the accompanying drawings.

In the embodiments described below, the audio output apparatus of the present technology is applied to an earphone. However, the scope of the present technology is not limited to earphones, but can be widely applied to various other audio output apparatuses such as headphones.

<Structure of Ear>

Figure 1:
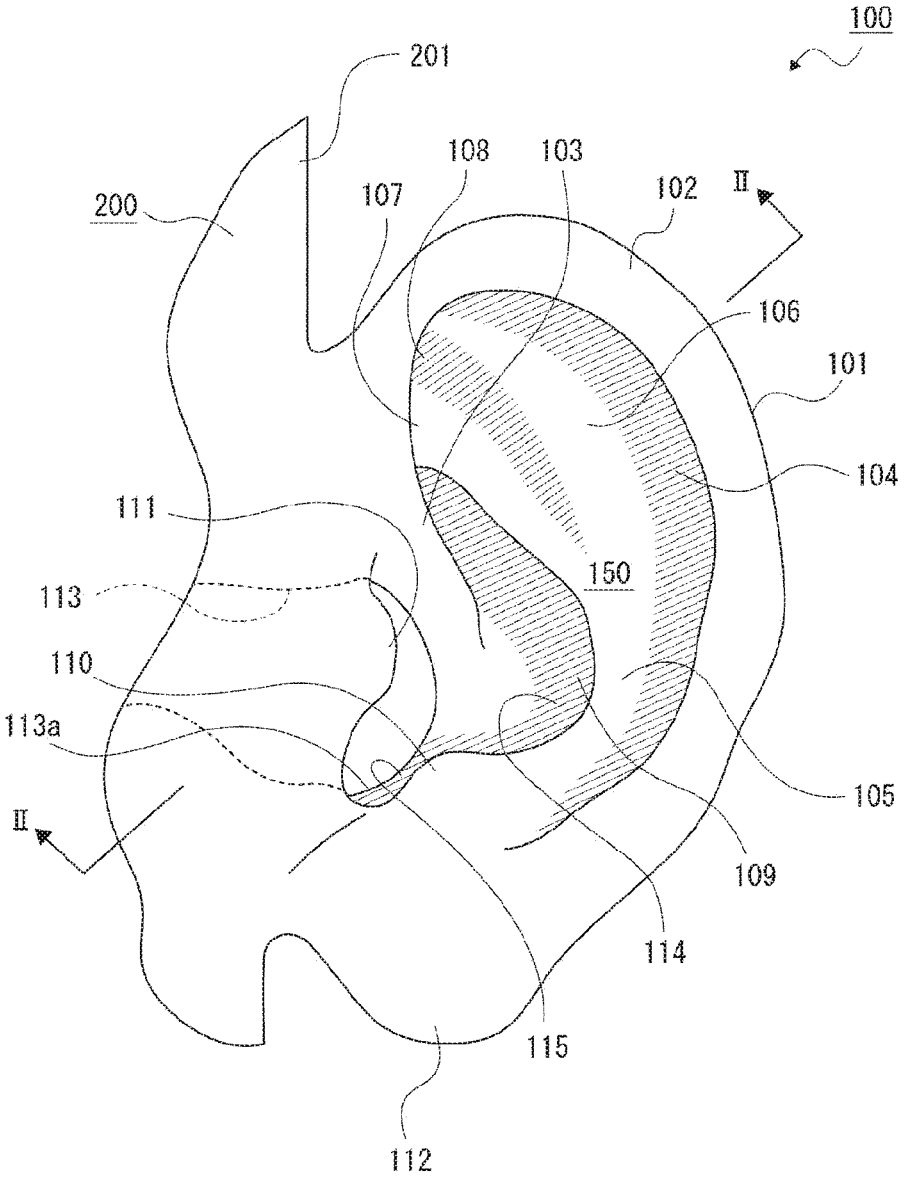
FIG. 1 shows, along with FIGS. 2 to 39, embodiments of an audio output apparatus of the present technology.
Figure 2:
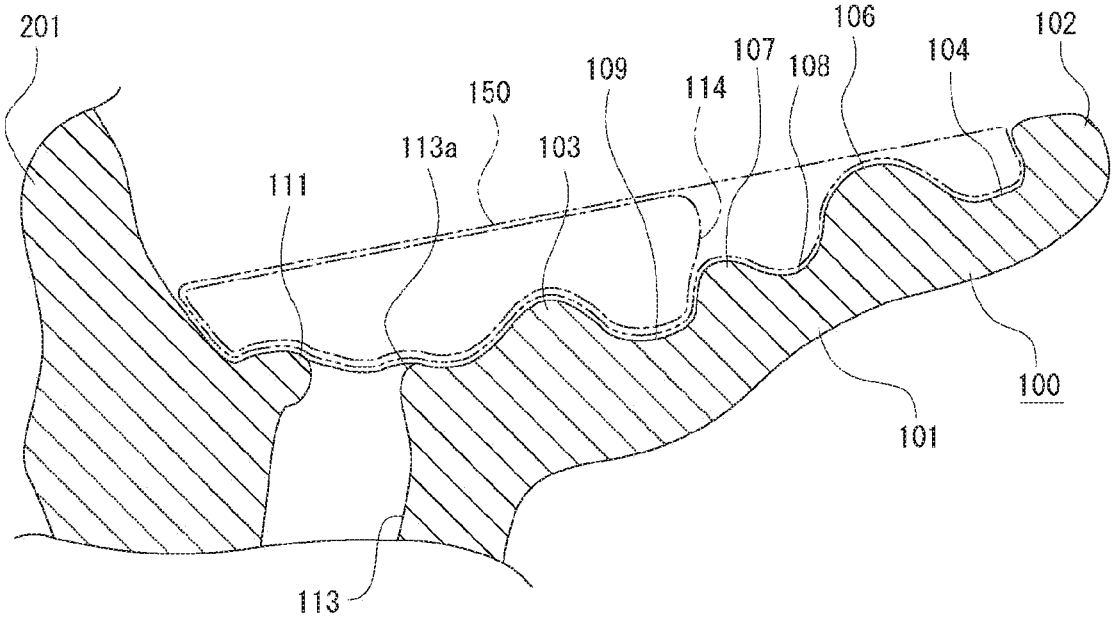
FIG. 2 is a cross-sectional view taken along the line II-II in FIG. 1.
Figure 3:
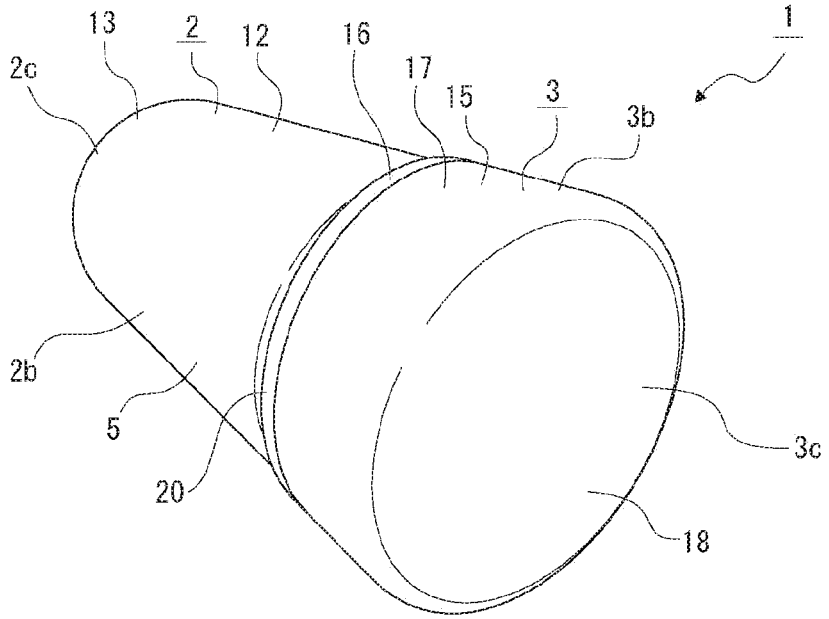
FIG. 3 is a perspective view of the audio output apparatus.
Figure 4:
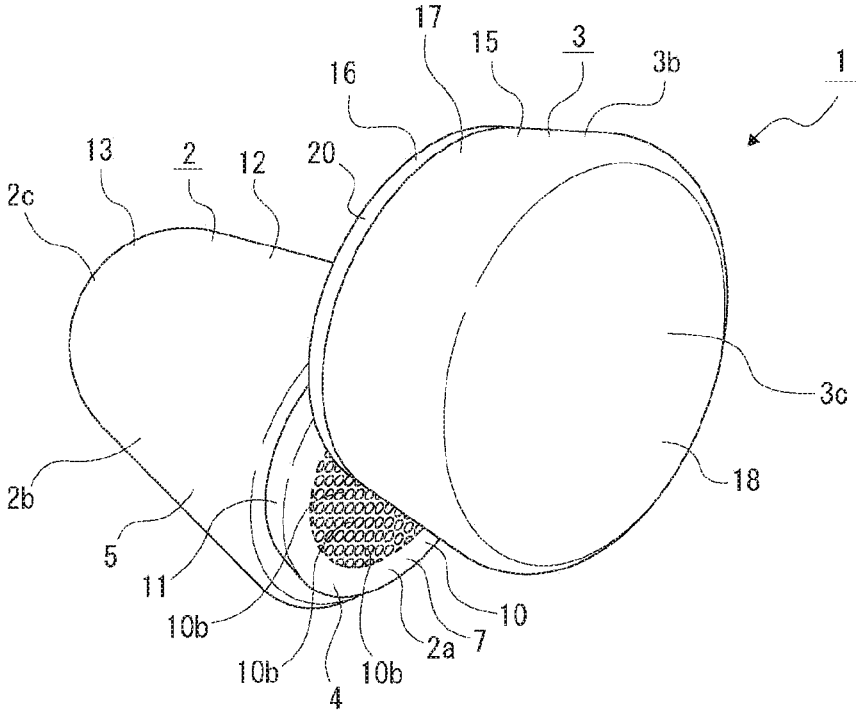
FIG. 4 is a perspective view of the audio output apparatus in a state where a rotating body is rotated relative to a base body.
Figure 5:
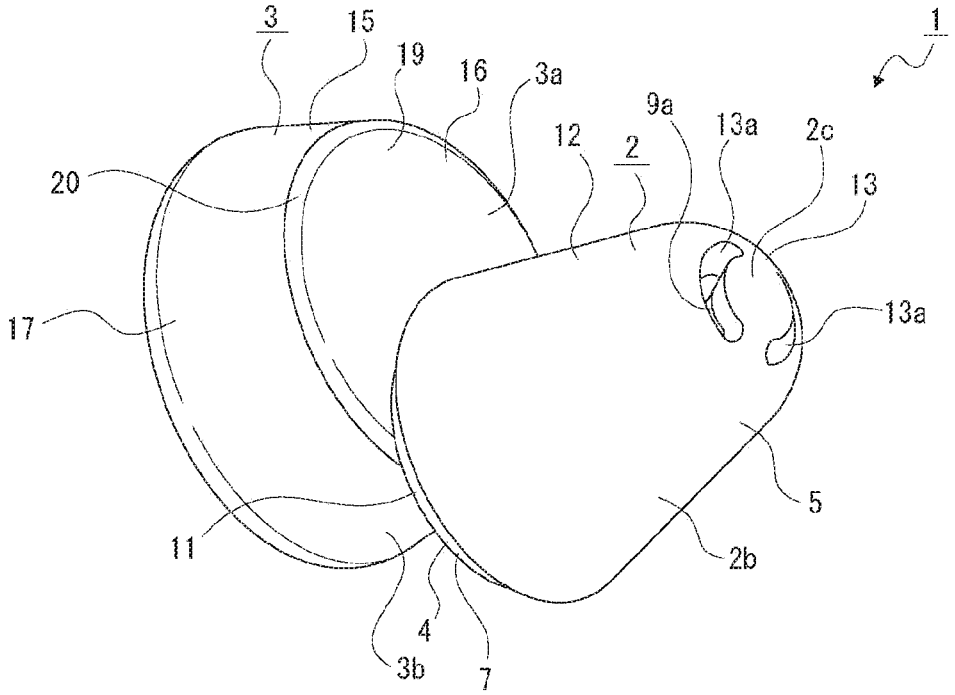
FIG. 5 is a perspective view of the audio output apparatus in a state where the rotating body is rotated relative to the base body, as seen from a direction different from the direction in FIG. 4.
Figure 6:
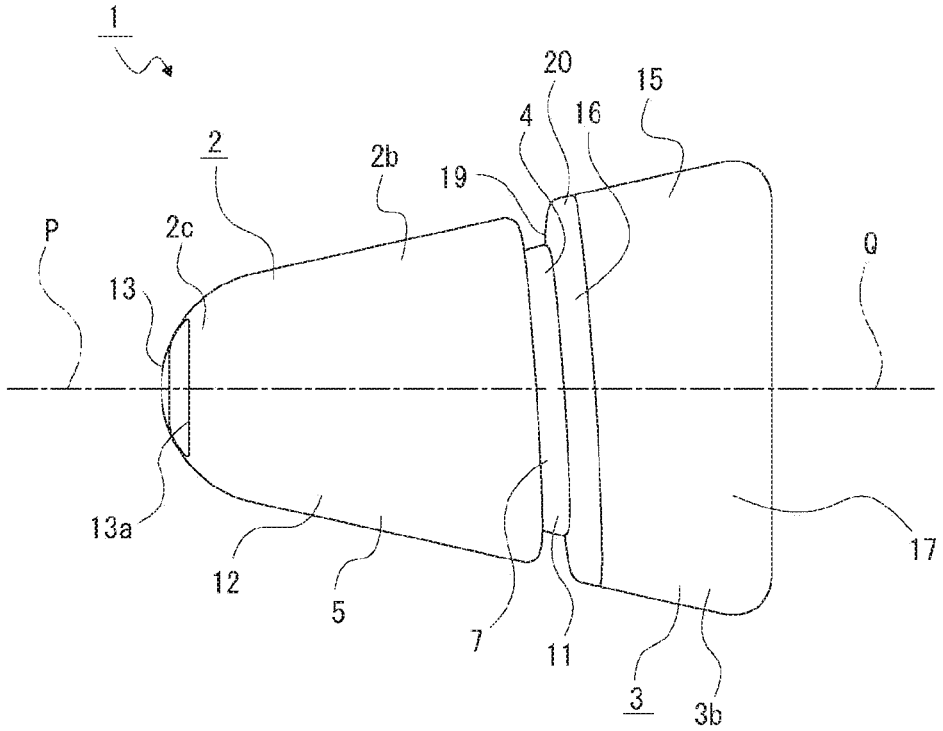
FIG. 6 is a front view of the audio output apparatus.
Figure 7:
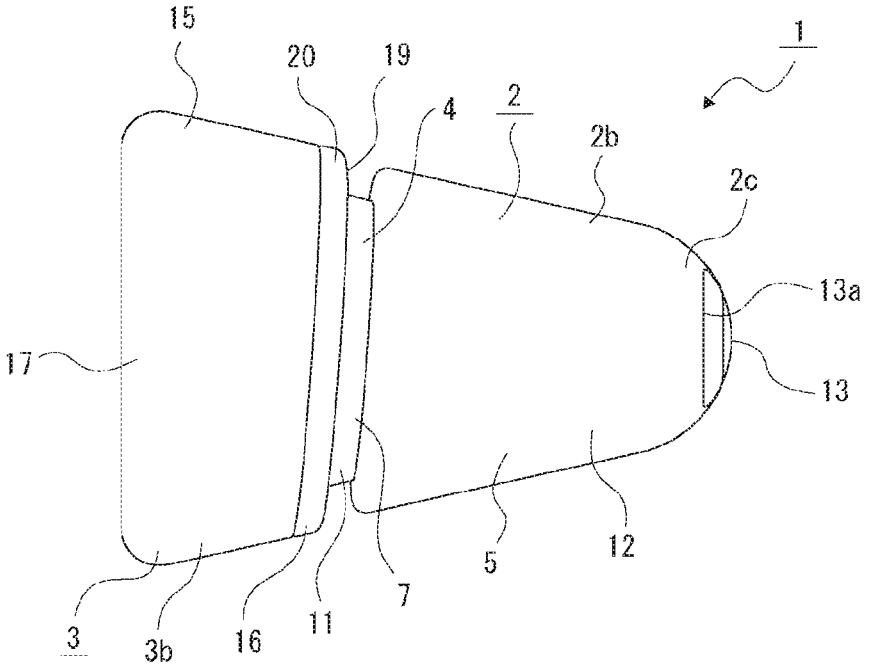
FIG. 7 is a rear view of the audio output apparatus.
Figure 8:
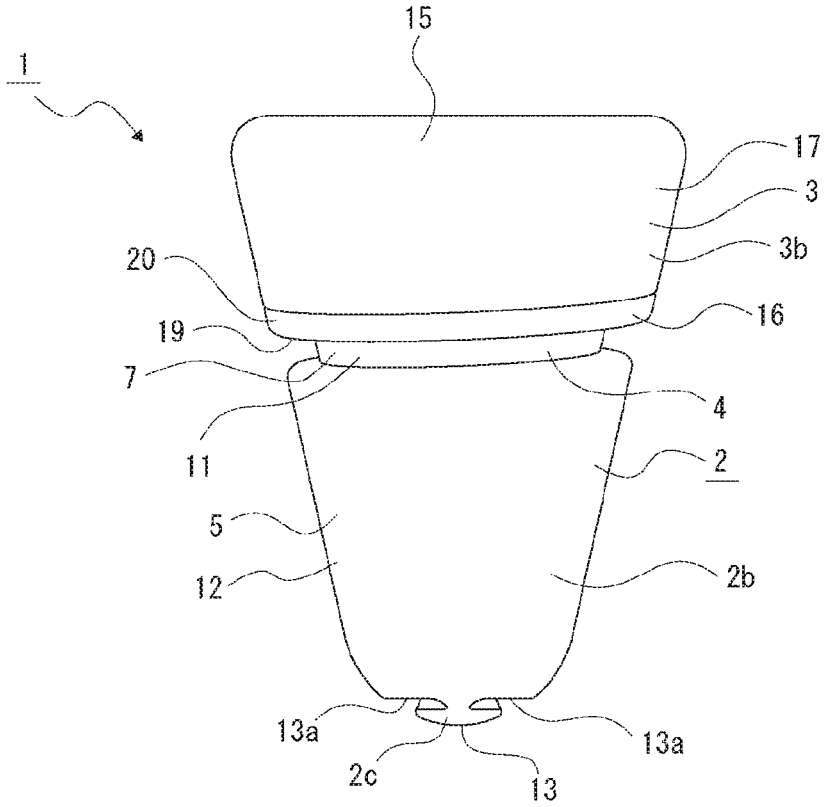
FIG. 8 is a plan view of the audio output apparatus.
Figure 9:
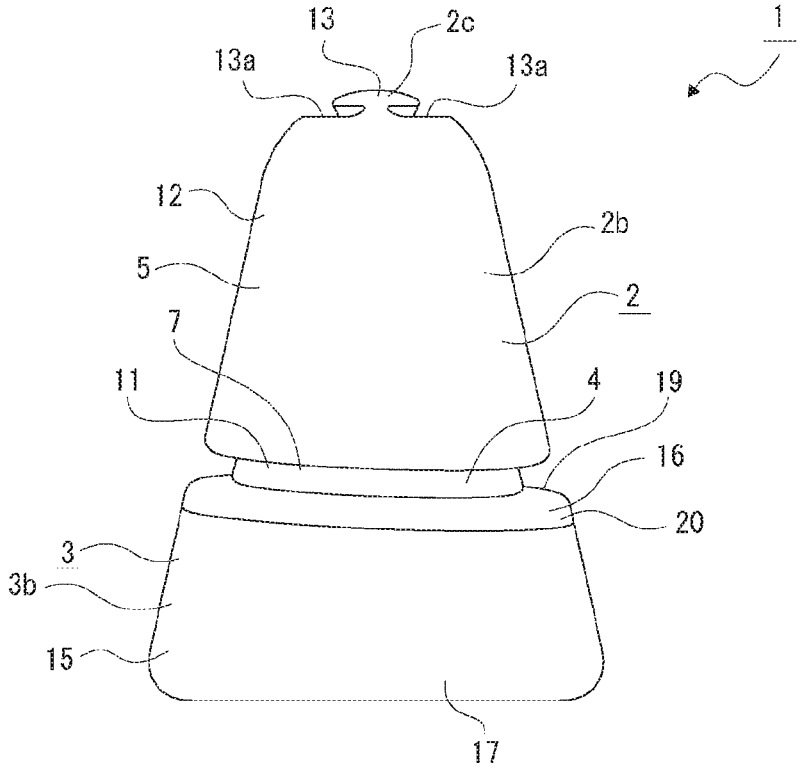
FIG. 9 is a bottom view of the audio output apparatus.
Figure 10:
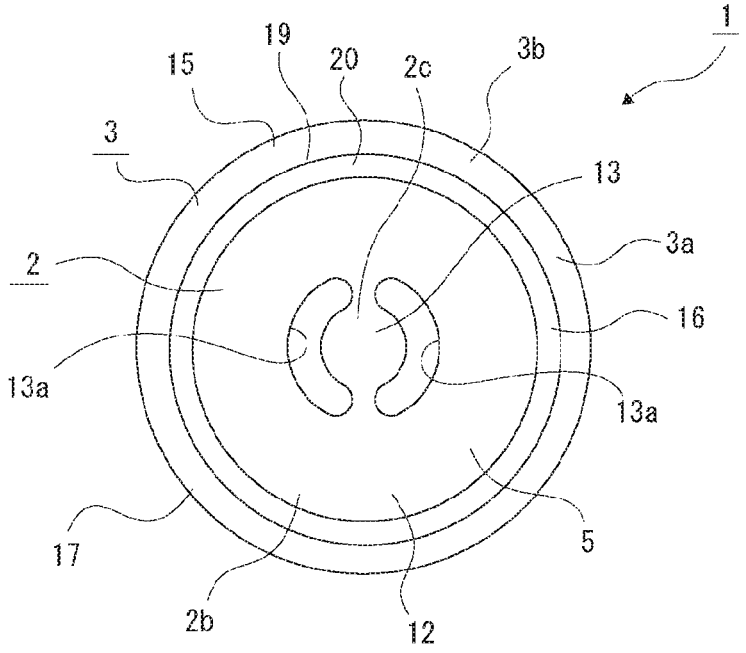
FIG. 10 is one side view of the audio output apparatus.
Figure 11:
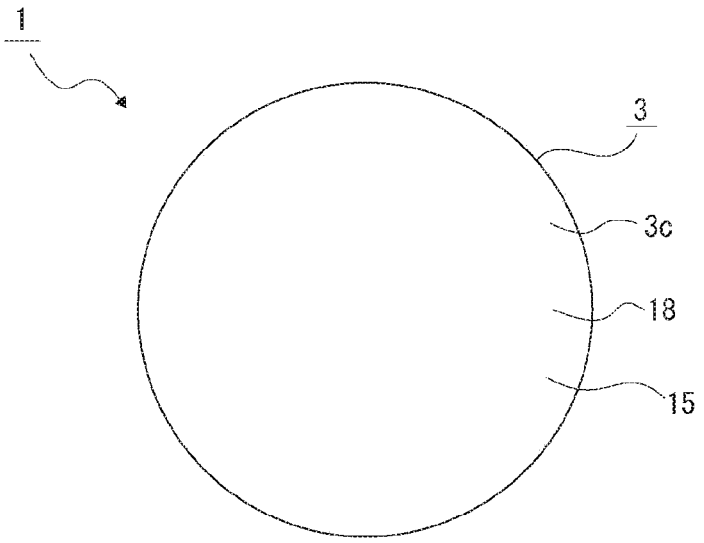
FIG. 11 is the other side view of the audio output apparatus.

First, the following describes a structure of an ear in which the audio output apparatus is to be fitted (see FIGS. 1 and 2).

Ears 100, 100 are part of a head 200 and each of the ears includes an auricle 101, 101 and various parts located inside the head 200 such as an eardrum, a semicircular canal, and a cochlea. The head 200 includes temporal regions 201, 201 located inside the auricles 101, 101, respectively, and the auricles 101, 101 protrude leftward or rightward from the temporal regions 201, 201, respectively.

The auricle 101 is in a shallow concave shape that is open substantially forward as a whole so as to have an inner space 150, and includes an outer edge including a portion called helix 102 and a portion called crus helicis 103, which is continuous with the helix 102 and located near the temporal region 201.

An inner portion of the helix 102 is concave and called fossa navicularis 104, and a substantially lower half of the inside of the fossa navicularis 104 is convex and called antihelix 105. Above the antihelix 105, there is a bifurcated convex portion continuous with the antihelix 105. The outer portion and the inner portion of the bifurcated portion are called superior crus of antihelix 106 and inferior crus of antihelix 107, respectively. A concave portion between the superior crus of antihelix 106 and the inferior crus of antihelix 107 is called fossa triangularis 108, and a concave portion inside the antihelix 105 and the inferior crus of antihelix 107 is called cymba conchae 109.

A portion continuous with the lower side of the antihelix 105 and evaginated toward the temporal region 201 to some extent is called antitragus 110. A portion on the temporal region 201 side opposed to the antitragus 110 and evaginated toward the antitragus 110 to some extent is called tragus 111, and a bottom end portion continuous with the helix 102 is called earlobe 112.

Between the antitragus 110 and the tragus 111, there is an entrance, called external acoustic opening 113*a*, to the ear canal 113. The ear canal 113 is in communication with the eardrum, the semicircular canal, and the like. A space that is included in the inner space 150 of the auricle 101 and is surrounded by the antihelix 105, the inferior crus of antihelix 107, and the crus helicis 103, that is, a space in front of the cymba conchae 109 is called a cavity of concha 114, which is in communication with the external acoustic opening 113*a* of the ear canal 113. A U-shaped open space that is included in the inner space 150 and continuous with the lower side of the cavity of concha 114 is called incisura intertragica 115.

The inner space 150 of the auricle 101 includes the cavity of concha 114, the incisura intertragica 115, and a space near the external acoustic opening 113*a* of the ear canal 113, and further includes the fossa navicularis 104, the antihelix 105, the superior crus of antihelix 106, the inferior crus of antihelix 107, the fossa triangularis 108, the antitragus 110, and a space in front of the tragus 111.

<Configuration of Audio Output Apparatus>

A configuration of audio output apparatuses 1, 1 will now be described (see FIGS. 3 to 12). One of the audio output apparatuses 1, 1 is used for a left ear 100 and the other one is used for a right ear 100. However, either audio output apparatus 1 of the two may be used to listen to sounds.

The audio output apparatus 1 includes a base body 2 that is at least partially inserted into the ear canal 113 of the ear 100 and a rotating body 3 that is rotatable relative to the base body 2.

Note that, unless otherwise specified, the following describes a configuration of the audio output apparatus 1 in a non-rotation state where the rotating body 3 is not rotated relative to the base body 2 yet. Also note that the base body 2 and the rotating body 3 are positioned side by side in a certain direction, and the following description indicates front-back, up-down, and left-right directions on the assumption that the base body 2 and the rotating body 3 are arranged along a left-right direction. However, the front-back, up-down, and left-right directions as shown below are for convenience of explanation, and the present technology is implemented without being limited to these directions.

The audio output apparatus 1 as a whole is formed in a substantially conical shape whose axial direction is along the left-right direction.

The base body 2 is formed in a substantially conical shape whose axial direction is along the left-right direction, and includes an enclosure 4 including, for example, a metal material or a resin material and an earpiece 5 including, for example, an elastically deformable material such as silicone, rubber, or urethane.

The base body 2 includes a facing surface 2*a*, which is a flat surface corresponding to the base of a conical shape, and an outer circumferential surface 2*b*, which corresponds to the lateral surface of the cone. The outer circumferential surface 2*b* is a surface of revolution formed by rotating a straight line on a plane including an imaginary central axis P (see FIGS. 6 and 12) with respect to the central axis P, and is formed so as to have a diameter becoming smaller as the diameter is farther away from the facing surface 2*a*. The axial direction of the central axis P is along the left-right direction and coincides with the direction along which the base body 2 and the rotating body 3 are arranged. A surface that is continuous with one end of the outer circumferential surface 2*b* of the base body 2, the one end being opposite to the facing surface 2*a*, is formed into a convex curved surface opposite to the facing surface 2*a*. The convex curved surface is a tip surface 2*c*. The tip surface 2*c* is formed to be substantially hemispherical, for example.

Figure 12:
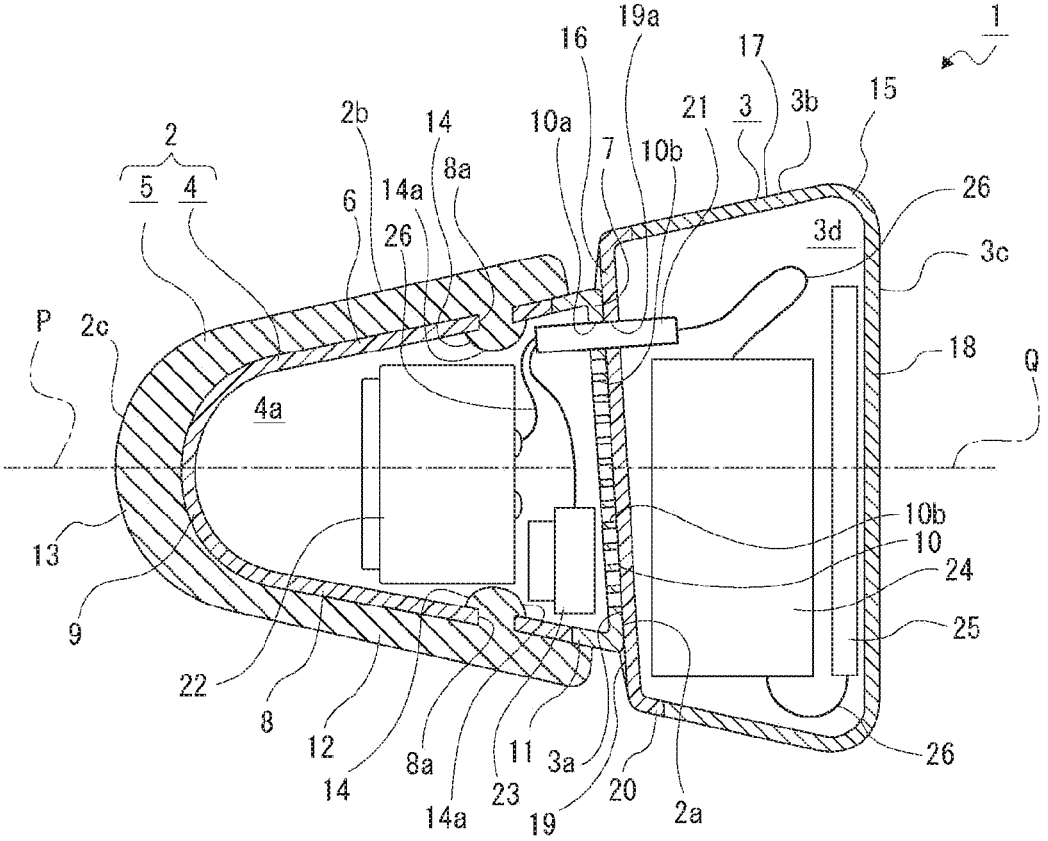
FIG. 12 is a cross-sectional view of the audio output apparatus.

The enclosure 4 is formed to be substantially conical by combining a bowl-like case portion 6 that is open to one side with respect to the left-right direction and a cover portion 7 that blocks the opening of the case portion 6 (see FIG. 12). The internal space of the enclosure 4 is formed into a placement space 4*a*.

The case portion 6 includes a circumferential portion 8 that is tubular and has a diameter becoming smaller toward one end with respect to the left-right direction and an end portion 9 that is substantially hemispherical and continuous with the one end of the circumferential portion 8 on the smaller diameter side. Coupling holes 8*a*, 8*a*, . . . are formed in the circumferential portion 8. Sound output holes 9*a*, 9*a* are formed in the end portion 9. The sound output holes 9*a*, 9*a* are each formed in an arc shape, for example.

The cover portion 7 includes a hole forming portion 10 that is disc-like and an annular portion 11 that protrudes from the outer periphery of the hole forming portion 10 toward the case portion 6.

The hole forming portion 10 is inclined with respect to the central axis P. A shaft support hole 10*a* is formed in the hole forming portion 10 at a position closer to the outer periphery of the hole forming portion 10. Accordingly, the shaft support hole 10*a* is formed at a position displaced from the central axis P. A plurality of sound input holes 10*b*, 10*b*, . . . is formed in the hole forming portion 10.

Figure 13:
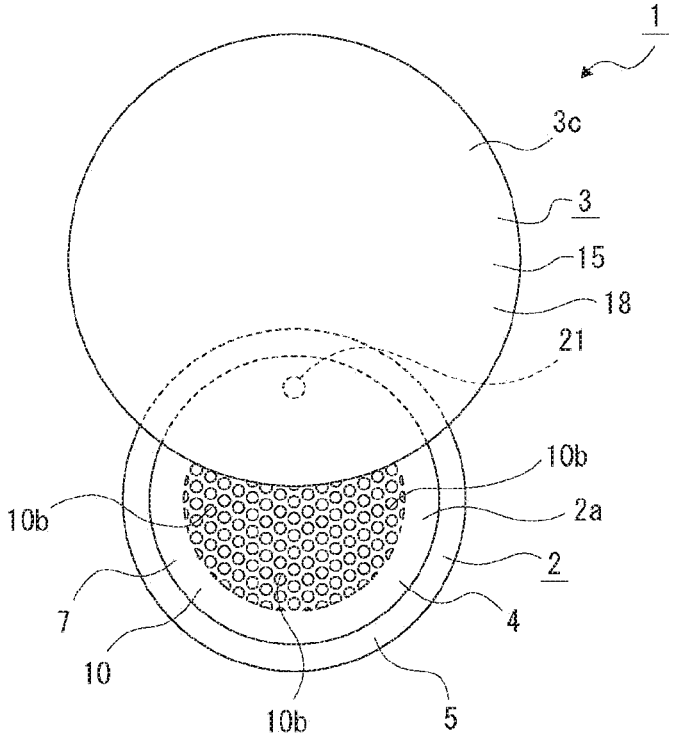
FIG. 13 is a side view showing an example of a shape of a sound input hole.
Figure 14:
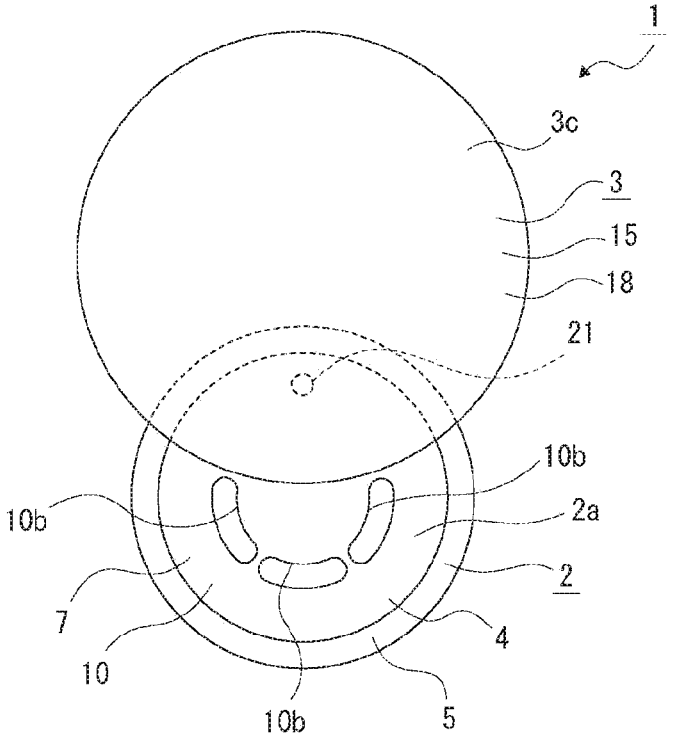
FIG. 14 is a side view showing another example of a shape of the sound input hole.

The sound input holes 10*b*, 10*b*, . . . can be formed in any shape as long as at least a certain aperture ratio is secured as a whole. The sound input hole 10*b* may be formed in, for example, a circular shape (see FIG. 13), or may be formed in, for example, an arc shape (see FIG. 14).

Note that, in the audio output apparatus 1, the blocked sound input holes 10*b*, 10*b*, . . . are caused to open by rotation of the rotating body 3 relative to the base body 2 as described later, and therefore, at least a certain aperture ratio refers to the aperture ratio of the sound input holes 10*b*, 10*b*, . . . caused to open by rotation of the rotating body 3 relative to the base body 2.

The annular portion 11 is joined to the circumferential portion 8 of the case portion 6.

In the enclosure 4, at least part of the cover portion 7 protrudes from the earpiece 5 toward the rotating body 3 (see FIG. 12).

The earpiece 5 is disposed in such a way as to totally cover the case portion 6 of the enclosure 4 from outside, and the inner surface of the earpiece 5 is in close contact with the outer surface of the case portion 6. The earpiece 5 is opened on one side with respect to the left-right direction, and includes an outer circumferential portion 12 that is tubular and has a diameter becoming smaller toward one side with respect to the left-right direction, a tip portion 13 that is substantially hemispherical and continuous with one end of the outer circumferential portion 12 on the smaller diameter side, and coupling protrusions 14, 14, . . . that protrude inward from the outer circumferential portion 12.

In the earpiece 5, the tip portion 13 has a greater thickness than the outer circumferential portion 12. Therefore, the outer circumferential portion 12 has a smaller thickness than the tip portion 13 in the earpiece 5, and thus the enclosure 4 located inside the earpiece 5 is enabled to have the placement space 4*a* that is larger in size, which makes it possible to reduce the size of the audio output apparatus 1 while securing a space large enough to place the individual units in the placement space 4*a*.

Sound output holes 13*a*, 13*a* are formed in the tip portion 13. The sound output holes 13*a*, 13*a* are each formed in an arc shape, for example.

On the coupling protrusion 14, there is disposed an engagement portion 14*a* having a diameter greater than diameters of other portions.

The coupling protrusions 14, 14, . . . of the earpiece 5 are individually inserted into the coupling holes 8*a*, 8*a*, . . . in the case portion 6, and then engaged with the inner opening edges of the coupling holes 8*a*, 8*a*, . . . when the engagement portions 14*a*, 14*a*, . . . , which have been elastically deformed during the insertion, reach the inner surface of the circumferential portion 8 to be elastically restored. In this way, the engagement portions 14*a*, 14*a*, . . . are individually engaged with the coupling holes 8*a*, 8*a*, . . . on the inner opening edges of the coupling holes, whereby the earpiece 5 is coupled to the enclosure 4.

Note that the enclosure 4 and the earpiece 5 may be integrally formed by another method such as, for example, the so-called insert molding in which the cavity of a molding die is filled with a molten material serving as a base material of the earpiece 5 in a state where the enclosure 4 is placed in the cavity.

Integrally forming the enclosure 4 and the earpiece 5 into the base body 2 makes it possible to reduce the number of parts in the audio output apparatus 1 and improve the strength of the base body 2.

In a state where the earpiece 5 is coupled to the enclosure 4, the sound output holes 9*a*, 9*a* in the enclosure 4 are individually aligned with the sound output holes 13*a*, 13*a* in the earpiece 5.

In the base body 2 configured as described above, the outer surface of the hole forming portion 10 in the cover portion 7 is designated as the facing surface 2*a*, the outer surface of the outer circumferential portion 12 in the earpiece 5 is designated as the outer circumferential surface 2*b*, and the outer surface of the tip portion 13 in the earpiece 5 is designated as the tip surface 2*c*.

The rotating body 3 is formed in a substantially cylindrical shape whose axial direction is along the left-right direction, and includes, for example, a metal material or a resin material.

The rotating body 3 includes a relative surface 3*a*, which is the surface of the cylindrical shape facing the facing surface 2*a*, and a circumferential surface 3*b*, which corresponds to the lateral surface of the cylinder. The circumferential surface 3*b* is a surface of revolution formed by rotating a straight line on a plane including a central axis Q (see FIGS. 6 and 12) with respect to the central axis Q, and is formed so as to have a diameter becoming larger as the diameter is farther away from the relative surface 3*a*. The inclination angle of the circumferential surface 3*b* with respect to the central axis Q is the same as the inclination angle of the outer circumferential surface 2*b* with respect to the central axis P. The rotating body 3 includes a bottom surface 3*c* that is circular and is formed on a surface of the cylindrical shape opposite to the relative surface 3*a*.

The rotating body 3 is formed such that the outer diameter of the relative surface 3*a* is equal to the outer diameter of the facing surface 2*a* or is larger than the outer diameter of the facing surface 2*a* to some extent, and that the diameter becomes larger from the relative surface 3*a* toward the bottom surface 3*c*. Therefore, the rotating body 3 has a larger outer diameter than the base body 2.

The rotating body 3 includes a housing portion 15 that is container-like and has an opening on the base body 2 side with respect to the left-right direction, and also includes a lid portion 16 that blocks the opening of the housing portion 15, the housing portion 15 and the lid portion 16 being coupled to each other (see FIG. 12). The internal space of the rotating body 3 is formed into a component placement space 3*d*.

The housing portion 15 includes a circumferential surface portion 17 that is tubular and has a diameter becoming smaller toward the base body 2 with respect to the left-right direction and a bottom portion 18 that is plate-like and continuous with one end of the circumferential surface portion 17 on the larger diameter side.

The lid portion 16 includes a base portion 19 that is disc-like and a rising portion 20 that is annular and protrudes from the outer periphery of the base portion 19 toward the circumferential surface portion 17.

The base portion 19 is inclined with respect to the central axis Q. The inclination angle of the base portion 19 with respect to the central axis Q is the same as the inclination angle of the hole forming portion 10 in the base body 2 with respect to the central axis P. A shaft support hole 19*a* is formed in the base portion 19 at a position closer to the outer periphery of the base portion 19. Accordingly, the shaft support hole 19*a* is formed at a position displaced from the central axis Q. The rising portion 20 is joined to the circumferential surface portion 17 of the housing portion 15.

In the rotating body 3 configured as described above, the outer surface of the base portion 19 in the lid portion 16 is designated as the relative surface 3*a*, the outer surface of the circumferential surface portion 17 in the housing portion 15 is designated as the circumferential surface 3*b*, and the outer surface of the bottom portion 18 in the housing portion 15 is designated as the bottom surface 3*c*.

In the audio output apparatus 1, the inclination angle of the outer circumferential surface 2*b* in the base body 2 with respect to the central axis P is the same as the inclination angle of the circumferential surface 3*b* in the rotating body 3 with respect to the central axis Q, and the inclination angle of the facing surface 2*a* in the base body 2 with respect to the central axis P is the same as the inclination angle of the relative surface 3*a* in the rotating body 3 with respect to the central axis Q. Furthermore, the facing surface 2*a* in the base body 2 and the relative surface 3*a* in the rotating body 3 are in surface contact with each other.

A fulcrum shaft 21 is inserted into the shaft support hole 10*a* in the enclosure 4 of the base body 2 and into the shaft support hole 19*a* in the rotating body 3. The fulcrum shaft 21 is formed to be substantially cylindrical, and its axial direction is orthogonal to the facing surface 2*a* and to the relative surface 3*a*. The fulcrum shaft 21 serves as a fulcrum of rotation on which the rotating body 3 rotates relative to the base body 2, and is located at a position (eccentric position) displaced from the central axis P and the central axis Q, that is, a position displaced from a middle portion (central portion) of the facing surface 2*a* and from a middle portion (central portion) of the relative surface 3*a*.

Therefore, the rotating body 3 is rotated relative to the base body 2 on the fulcrum shaft 21 that serves as a fulcrum and is located at a position displaced from the central axis P and the central axis Q. During the rotation, the facing surface 2*a* and the relative surface 3*a* in surface contact with each other are moved slidingly.

In the non-rotation state where the rotating body 3 is not rotated yet relative to the base body 2, the central axis P and the central axis Q are aligned with the same straight line. Furthermore, in the non-rotation state, the sound input holes 10*b*, 10*b*, . . . formed in the enclosure 4 are blocked by the rotating body 3 with the facing surface 2*a* of the base body 2 and the relative surface 3*a* of the rotating body 3 are in surface contact with each other.

A speaker 22 and a microphone 23 are placed in the placement space 4*a* in the enclosure 4. For example, a dynamic type speaker or a balanced armature type speaker may be used as the speaker 22. The microphone 23 is placed closer to the sound input holes 10*b*, 10*b*, . . . than the speaker 22.

A battery (battery) 24 and a control board 25 are placed in the component placement space 3*d* in the rotating body 3. For example, the so-called button type being substantially cylindrical is used as the battery 24. The control board 25 has functions of, for example, exerting various types pf control relating to sound signals output from the speaker 22, various types of control relating to sound signals input to the microphone 23, control relating to the charge capacity of the battery 24, and other control. The battery 24 and the control board 25 are positioned to face each other in the left-right direction. For example, the battery 24 is positioned closer to the base body 2 than the control board 25.

The axial direction of the battery 24 and the orientation of the control board 25 coincide with the left-right direction, which is the direction along which the base body 2 and the rotating body 3 are arranged.

Accordingly, both the thickness direction of the battery 24 and the thickness direction of the control board 25 coincide with the direction along which the base body 2 and the rotating body 3 are arranged. Therefore, the size of the audio output apparatus 1 can be reduced with respect to the direction along which the base body 2 and the rotating body 3 are arranged.

In addition, as described above, the battery 24 and the control board 25 are positioned to face each other in the left-right direction.

Accordingly, the battery 24 and the control board 25 are positioned side by side in the direction along which the base body 2 and the rotating body 3 are arranged. Therefore, the size of the rotating body 3 can be reduced with respect to the direction orthogonal to the direction along which the base body 2 and the rotating body 3 are arranged and, furthermore, the size of the audio output apparatus 1 can be reduced with respect to the direction along which the base body 2 and the rotating body 3 are arranged.

An antenna (not illustrated) is placed inside the base body 2 or the rotating body 3. For example, part of the antenna is connected to the control board 25, and the antenna has a function of transmitting and receiving signals to and from various external devices including communication devices such as a mobile device by wireless communication or the like. Examples of a communication method that may be used for communication between the communication device and the antenna include the Bluetooth (trademark) short distance wireless communication method, the Wi-Fi (trademark) (Wireless Fidelity) method, and other methods.

As described above, the antenna for transmitting and receiving signals is disposed in the audio output apparatus 1. Therefore, the need for connecting a cable to the apparatus for transmitting and receiving signals to and from an external device is eliminated, and the rotating body 3 can be rotated relative to the base body 2 smoothly without any cable interfering with rotation of the rotating body 3 relative to the base body 2.

The battery 24 is connected to the speaker 22, the microphone 23, and the control board 25 by connection lines 26, 26, . . . , and the control board 25 is connected to the speaker 22 and the microphone 23 via the battery 24 and the connection lines 26, 26. Therefore, power is supplied from the battery 24 to the speaker 22, the microphone 23, and the control board 25 via the connection lines 26, 26, . . . .

The connection lines 26, 26 connecting the battery 24 to the speaker 22 and the microphone 23 are partially inserted through the fulcrum shaft 21.

Accordingly, the speaker 22 and the microphone 23 are connected to the control board 25 by the connection lines 26 and 26 that are partially inserted through the fulcrum shaft 21. Therefore, the need for a dedicated component for inserting the connection lines 26, 26 into a region between the inside of the base body 2 and the inside of the rotating body 3 is eliminated, and the manufacturing cost can be reduced through reduction in the number of components of the audio output apparatus 1.

Furthermore, since the connection lines 26, 26 are protected by the fulcrum shaft 21, the connection lines 26, 26 can be prevented from being disconnected.

<Fitting Audio Output Apparatus in Ear>

Operations for fitting the audio output apparatus 1 in the ear 100 will now be described below (see FIGS. 15 to 20). Note that the following describes, as an example, operations for fitting the apparatus in the left ear 100.

Figure 15:
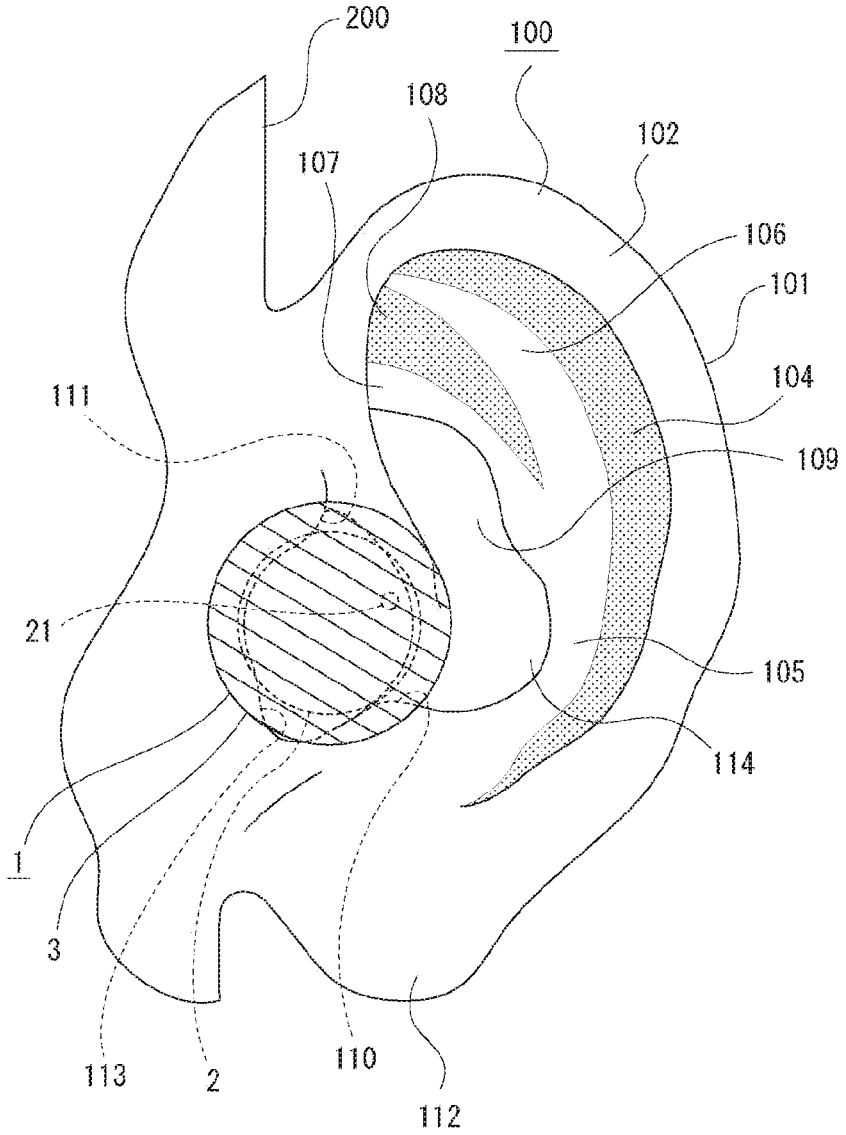
FIG. 15 is a diagram illustrating a state where the base body in a non-rotation state is inserted into the ear canal.
Figure 16:
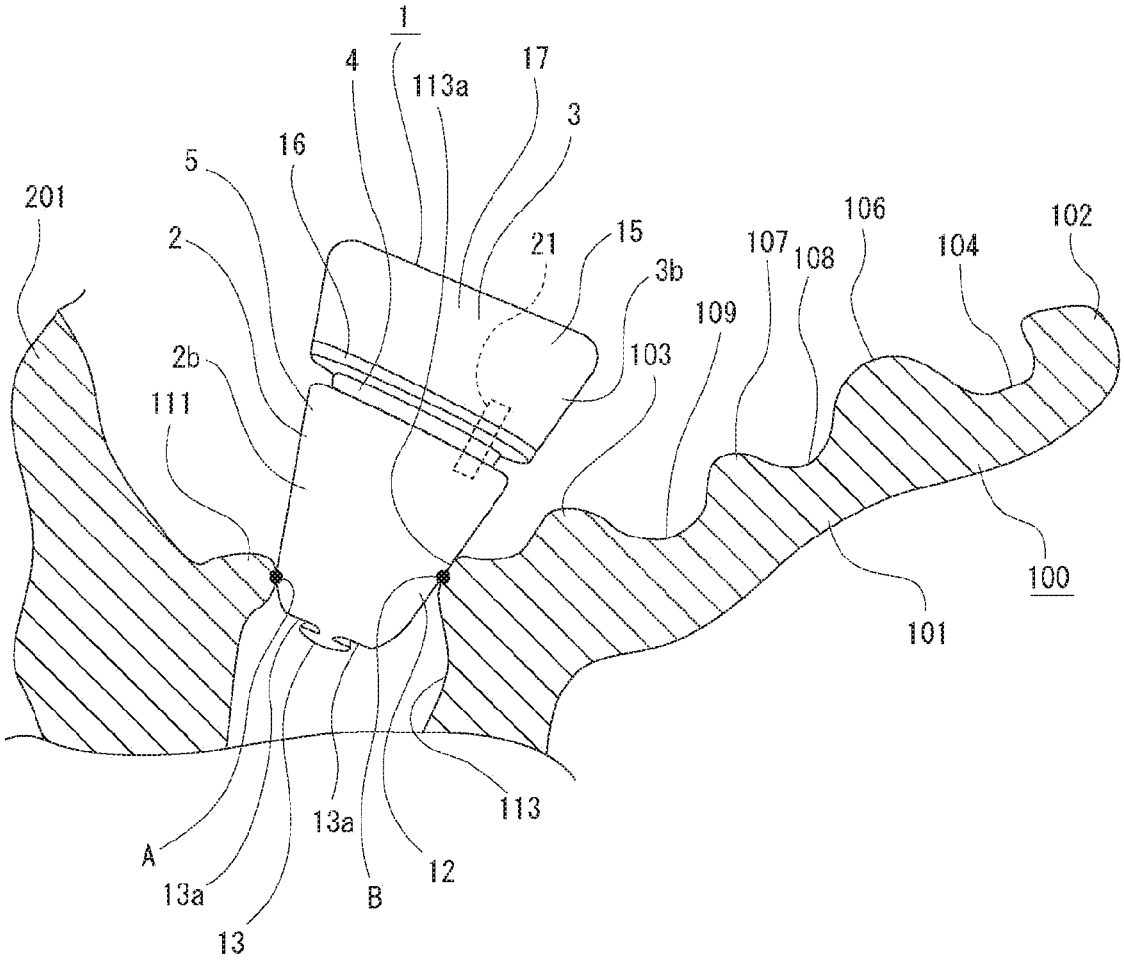
FIG. 16 is a diagram illustrating the state where the base body in the non-rotation state is inserted into the ear canal, as seen from a direction different from the direction in FIG. 15.

First, when the audio output apparatus 1 is in the non-rotation state, a portion of the earpiece 5 in the base body 2 on the tip portion 13 side is inserted into the ear canal 113 (see FIGS. 15 and 16). In general, the opening edge near the external acoustic opening 113*a* of the ear canal 113 in the ear 100 is in a substantially oval shape vertically long. Thus, when the earpiece 5 is inserted into the ear canal 113, the earpiece 5 comes into contact with the opening edge of the ear canal 113 at least at two points (a point A and a point B in FIG. 16).

Therefore, the earpiece 5 is in contact with the opening edge of the ear canal 113 at least at two points, whereby the audio output apparatus 1 is held on the ear 100 and becomes less likely to fall off the ear 100.

Note that it is desirable that the fulcrum shaft 21 is positioned above the central axes P and Q when the earpiece 5 is inserted into the ear canal 113.

At this point of time, the rotating body 3 is at least partially inserted into the cavity of concha 114, and the circumferential surface 3*b* is either in contact with at least one of the antitragus 110 or the tragus 111 or in contact with nothing in the ear 100. Furthermore, since the audio output apparatus 1 is in the non-rotation state at this point of time, the sound input holes 10*b*, 10*b*, . . . formed in the enclosure 4 are blocked by the rotating body 3 with the facing surface 2*a* of the base body 2 and the relative surface 3*a* of the rotating body 3 are in surface contact with each other.

Next, the rotating body 3 is rotated relative to the base body 2 (see FIGS. 17 to 20). The rotation of the rotating body 3 relative to the base body 2 is made, for example, in a direction along which the rotating body 3 is displaced upward from the front of the base body 2. During the operation, since the rotating body 3 has a larger outer diameter than the base body 2 as described above, the user rotates the rotating body 3 having a larger diameter than the base body 2 by putting the user's fingers on the rotating body 3. Accordingly, the rotating body 3 is easier to hold with fingers, which ensures better rotational operability of the rotating body 3.

When the rotating body 3 is rotated relative to the base body 2, the rotating body 3 is gradually away from the antitragus 110 and the tragus 111. Then, while the rotating body 3 is at least partially inserted into the cavity of concha 114, the circumferential surface 3*b* comes into contact with, and is pressed against, the front edge of the antihelix 105 or the front edge of the inferior crus of antihelix 107 at least at one point (a point C in FIGS. 18 and 20).

Accordingly, the base body 2 is in contact with the ear 100 at least at two points (the point A and the point B) while the rotating body 3 is in contact with the ear 100 at least at one point (the point C), totaling at least three points. Therefore, the audio output apparatus 1 is stably fitted in the ear 100.

Figure 17:
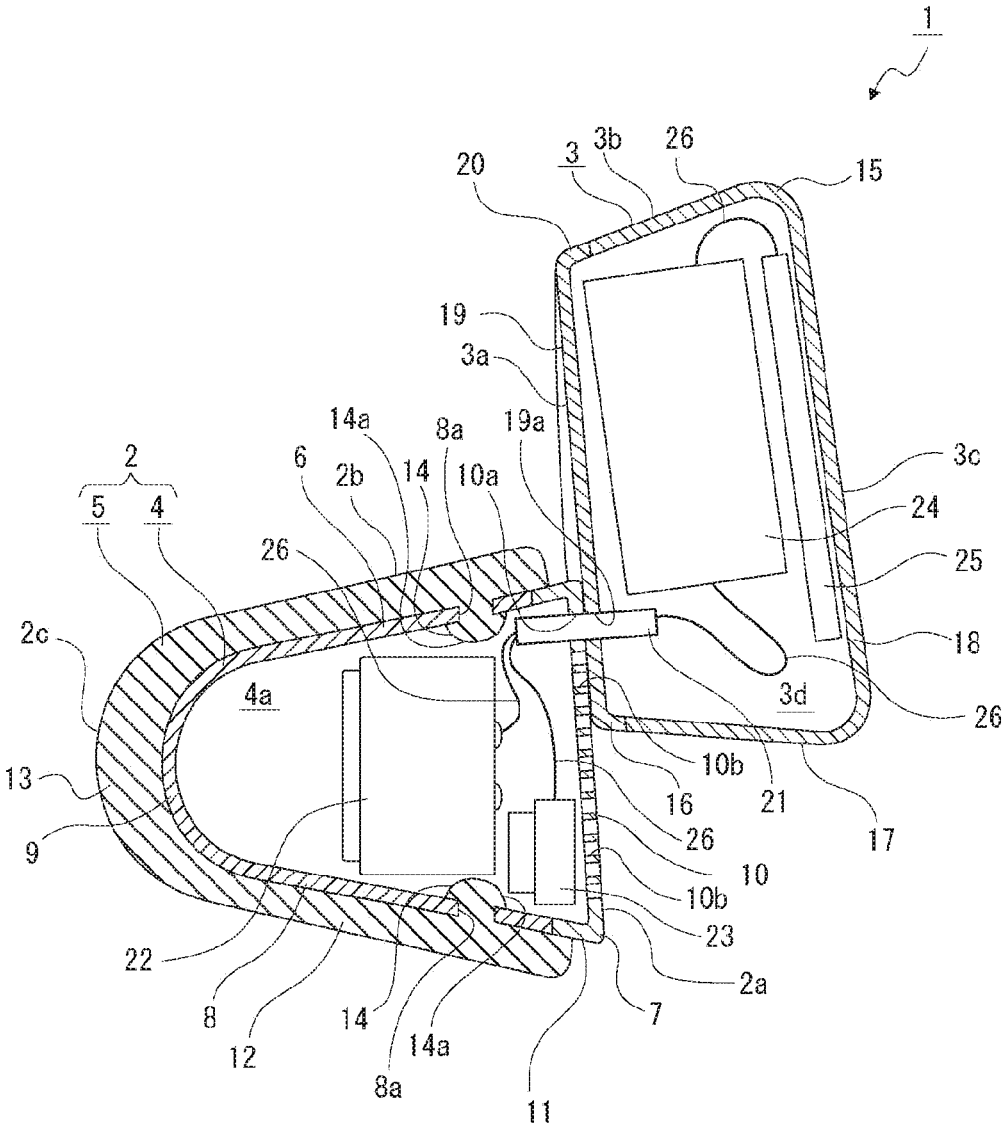
FIG. 17 is a cross-sectional view showing a state where the rotating body is rotated relative to the base body.
Figure 18:
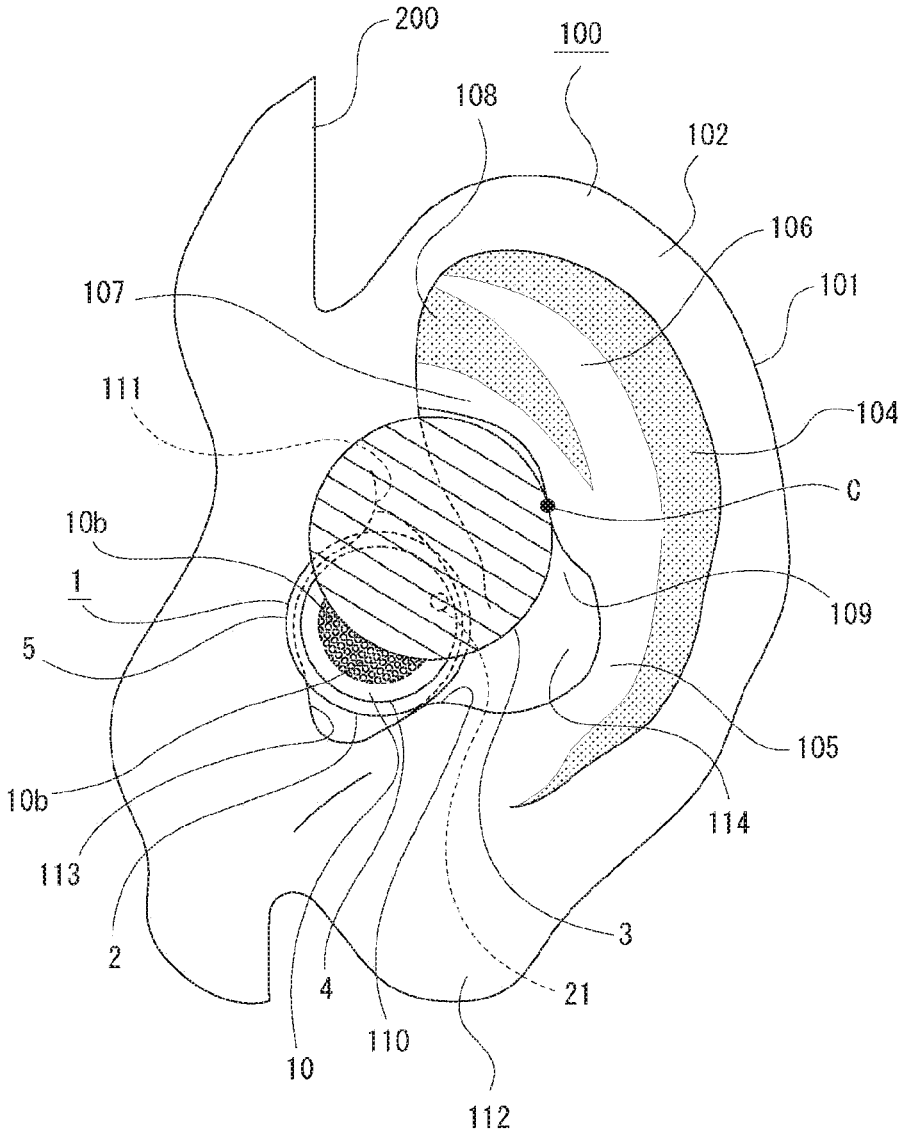
FIG. 18 is a diagram illustrating a state where the rotating body is rotated relative to the base body and the audio output apparatus is fitted in the ear.

While the rotating body 3 is being rotated relative to the base body 2, the sound input holes 10*b*, 10*b*, . . . blocked by the rotating body 3 are gradually opened (see FIG. 17).

Thus, the sound input holes 10*b*, 10*b*, . . . are opened as the rotating body 3 is being rotated relative to the base body 2. Therefore, moisture and dust are prevented from entering the sound input holes 10*b*, 10*b*, . . . in the non-rotation state, whereby the audio output apparatus 1 has improved waterproof and dustproof properties.

Figure 19:
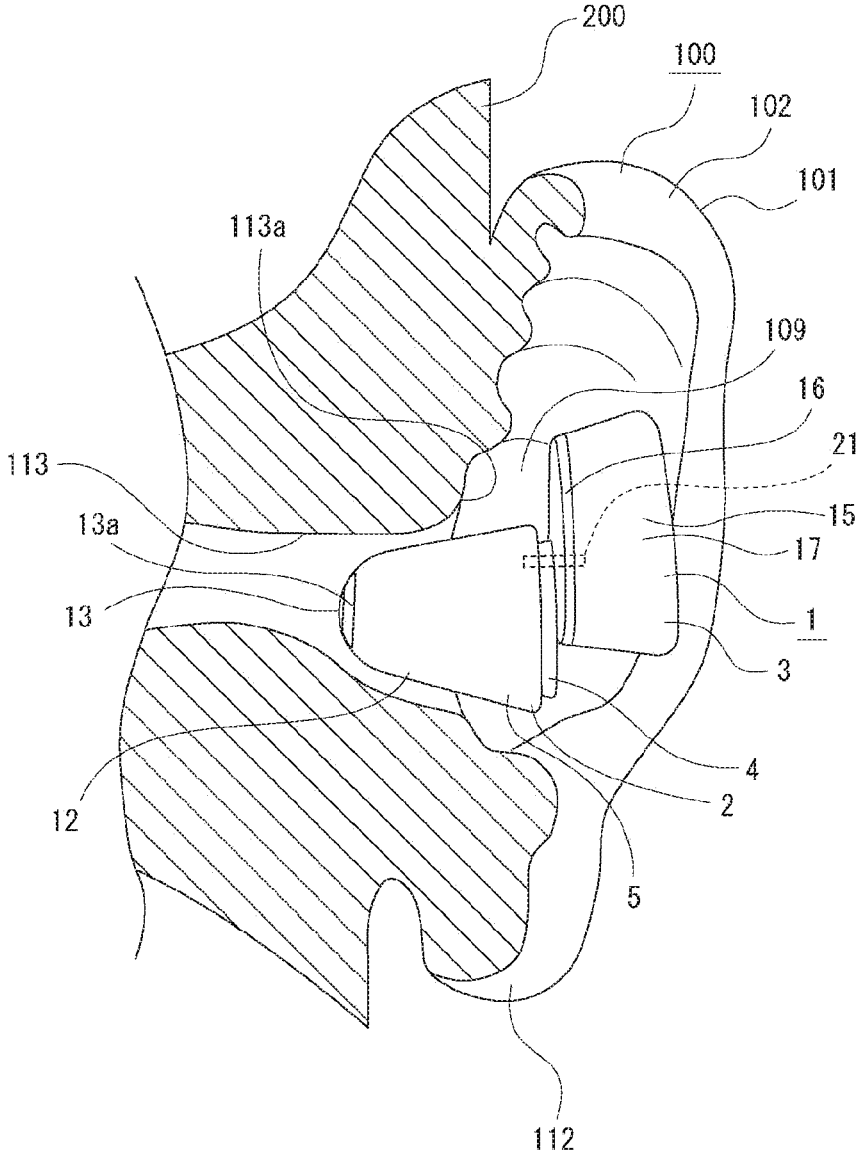
FIG. 19 is a diagram illustrating a state where the rotating body is rotated relative to the base body and the audio output apparatus is fitted in the ear, as seen from a direction different from the direction in FIG. 18.
Figure 20:
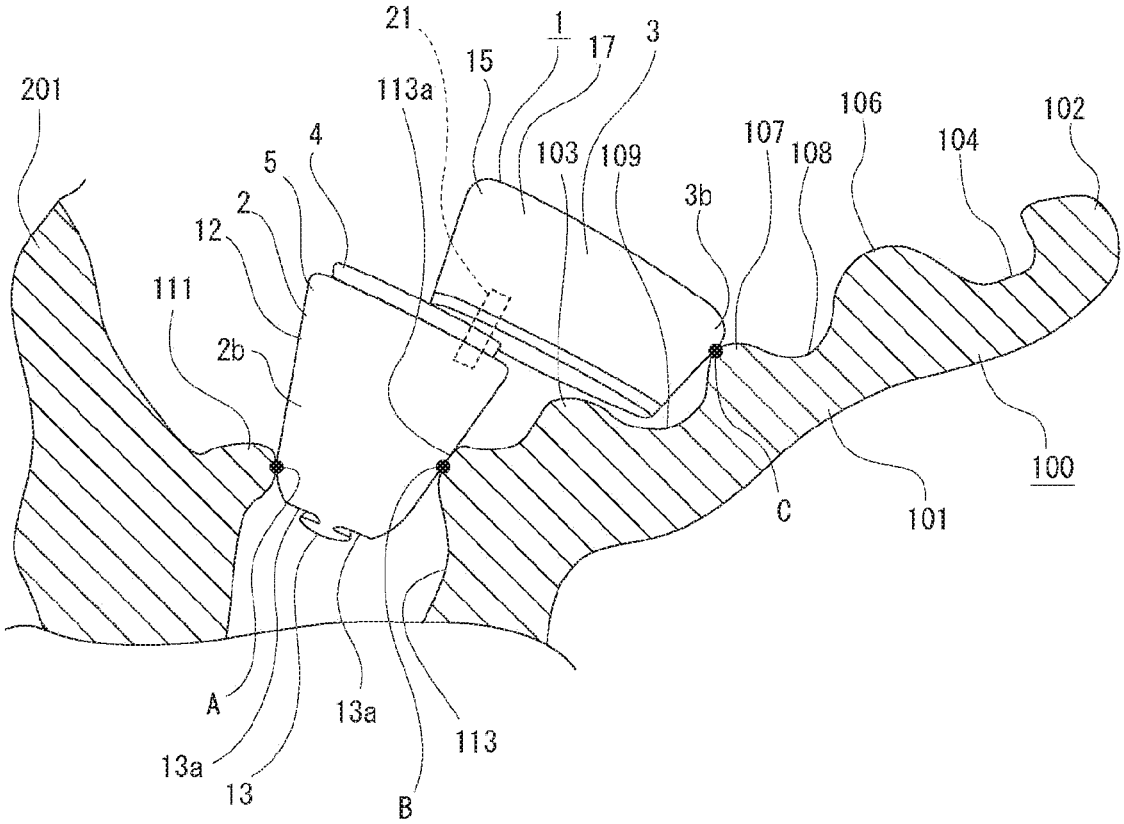
FIG. 20 is a diagram illustrating a state where the rotating body is rotated relative to the base body and the audio output apparatus is fitted in the ear, as seen from a direction different from the directions in FIGS. 18 and 19.

Note that, in a state where the audio output apparatus 1 is fitted in the ear 100, the whole audio output apparatus 1 is desirably located inside the auricle 101 (see FIG. 19). When the whole audio output apparatus 1 is located inside the ear 100, the audio output apparatus 1 being fitted in the ear 100 does not protrude outward from the ear 100. Thus, the hand and fingers are less likely to touch the audio output apparatus 1, the audio output apparatus 1 is less likely to fall off the ear 100, and it can be assured that the audio output apparatus 1 is stably fitted in the ear 100.

As described above, in a state where the audio output apparatus 1 is fitted in the ear 100, music data (sound signals) transmitted from, for example, a communication device is received by the antenna, and the received music data is controlled by the control board 25, and a sound is output from the speaker 22. The sound output from the speaker 22 passes through the sound output holes 9*a*, 9*a*, the sound output holes 13*a*, 13*a*, and the ear canal 113 to reach the eardrum.

Note that, in a state where the audio output apparatuses 1, 1 are fitted in the left ear 100 and the right ear 100, respectively, a signal received by the antenna in one audio output apparatus 1 is transmitted to the antenna in the other audio output apparatus 1, thereby enabling the sound to be output in stereo mode. However, another configuration is also possible in which music data (a sound signal) transmitted from the communication device is received by each of the antennas in the two audio output apparatuses 1, 1.

Furthermore, when a sound is output from the speaker 22, an external sound is input to the microphone 23 through the sound input holes 10*b*, 10*ba*, . . . , and a noise canceling function of canceling an input sound constituting a noise is executed. The noise canceling function is fulfilled by, for example, detecting a noise in an external sound and generating, through the control board 25, a noise canceling signal so that the user perceives each detected noise to a minimum extent.

SUMMARY

As described above, the audio output apparatus 1 includes: the base body 2 that is at least partially inserted into the ear canal 113; the rotating body 3 that is rotatable relative to the base body 2; and the fulcrum shaft 21 that serves as a fulcrum of rotation of the rotating body 3 relative to the base body 2, in which the rotating body 3 is rotatable relative to the base body 2 on a fulcrum at a position displaced from a middle portion of the facing surface 2*a* or a position displaced from a middle portion of the relative surface 3*a*, and, in a state where the base body 2 is inserted into the ear canal 113, the rotating body 3 rotated relative to the base body 2 is in contact with part of the ear 100.

Thus, the rotating body 3 is rotated relative to the base body 2 inserted into the ear canal 113 on a fulcrum at a position displaced from a middle portion of the facing surface 2*a* or the relative surface 3*a*, and resultingly the rotating body 3 is brought into contact with part of the ear 100. Therefore, it is made possible to simplify the structure of the audio output apparatus 1 and ensure that the audio output apparatus 1 is stably fitted in the ear 100.

Furthermore, the rotating body 3 rotated relative to the base body 2 is at least partially inserted into the cavity of concha 114.

Thus, the audio output apparatus 1 is fitted in the ear 100 in a state where the base body 2 is in contact with the opening edge of the ear canal 113 and the rotating body 3 is at least partially inserted into the cavity of concha 114. Therefore, it is made possible to ensure that the audio output apparatus 1 is stably fitted in the ear 100 with the audio output apparatus 1 protruding from the ear 100 by a limited amount.

Moreover, the rotating body 3 rotated relative to the base body 2 is at least partially brought into contact with the antihelix 105 or the inferior crus of antihelix 107.

Thus, the audio output apparatus 1 is fitted in the ear 100 in a state where the base body 2 is in contact with the opening edge of the ear canal 113 and at least part of the rotating body 3 is in contact with the antihelix 105 or the inferior crus of antihelix 107. Therefore, the position at which the base body 2 is in contact with the ear 100 is separated from the position at which the rotating body 3 is in contact with the ear 100, and it is made possible to ensure that the audio output apparatus 1 is stably fitted in the ear 100.

Furthermore, the facing surface 2*a* and the relative surface 3*a* are inclined with respect to the planes orthogonal to the central axes P and Q, respectively, and the axial direction of the fulcrum shaft 21 is along the direction orthogonal to the facing surface 2*a*.

Thus, the facing surface 2*a* and the relative surface 3*a* are inclined with respect to the central axes P and Q, respectively, and the axial direction of the fulcrum shaft 21 is along the direction orthogonal to the facing surface 2*a*. Therefore, the rotating body 3 can be easily inserted into the cavity of concha 114 when the rotating body 3 is rotated relative to the base body 2, and it is made possible to ensure that the audio output apparatus 1 is more stably fitted in the ear 100.

In addition, since the facing surface 2*a* and the relative surface 3*a* are in surface contact with each other, there is no gap between the facing surface 2*a* and the relative surface 3*a*. Therefore, it is made possible to reduce the size of the audio output apparatus 1 while improving the waterproof and dustproof properties of the audio output apparatus 1 because moisture and dust are more unlikely to enter a region between the facing surface 2*a* and the relative surface 3*a*.

Furthermore, the circumferential surface 3*b* of the rotating body 3 is formed in a curved surface. Therefore, when the rotating body 3 is rotated relative to the base body 2, the circumferential surface 3*b* formed in a curved surface is brought into contact with, and pressed against, part of the ear 100, and thus it is made possible to ensure that the rotating body 3 is in good contact with the ear 100 when fitted in the ear 100.

Moreover, the base body 2 is formed in a tapered shape whose outer size becomes gradually smaller as the base body 2 is farther away from the rotating body 3.

Therefore, since the base body 2 formed in a tapered shape is inserted into the ear canal 113, the base body 2 is inserted into the ear canal 113 and comes into contact with the opening edge of the ear canal 113 without regard to the size of the ear canal 113, and it is made possible to ensure that the audio output apparatus 1 is stably fitted in the ear without regard to the size of the ear canal 113.

Furthermore, since the base body 2 is inserted into the ear canal 113 without regard to the size of the ear canal 113, it is not necessary to replace earpieces in different sizes in accordance with the size of the ear canal 113, thereby improving the ease-of-use of the audio output apparatus 1.

Moreover, the base body 2 is formed in a substantially conical shape.

Therefore, the base body 2 is inserted into the ear canal 113 and comes into contact with the opening edge of the ear canal 113 without regard to the size of the ear canal 113, and it is made possible to ensure that the audio output apparatus 1 is reliably fitted in the ear 100 without regard to the size of the ear canal 113 and that the audio output apparatus 1 is more stably fitted in the ear 100.

Furthermore, the outer surface of the tip portion 13 of the base body 2 is formed in a curved shape convex toward the tip side. Therefore, the base body 2 is inserted into the ear canal 113 from the tip portion 13 whose outer surface is formed in a curved shape convex toward the tip side, and thus the base body 2 can be smoothly inserted into the ear canal 113.

Moreover, the base body 2 includes the enclosure 4, the inside of which is formed into the placement space 4*a*, and also includes the earpiece 5 that is in close contact with at least part of the outer surface of the enclosure 4, and the earpiece 5 includes an elastically deformable material.

Thus, the elastically deformable earpiece 5 is brought into contact with the opening edge of the ear canal 113. Therefore, it is made possible to ensure that the base body 2 is in good contact with the ear 100 when fitted in the ear 100.

Note that the rotating body 3 is rotatable in opposite directions (in two directions) relative to the base body 2.

Thus, the user can select a rotating direction to rotate the rotating body 3. Therefore, in a case where the audio output apparatus 1 is fitted in the left ear 100 and the audio output apparatus 1 is fitted in the right ear 100, the base bodies 2 can be rotated in opposite directions, and the audio output apparatuses 1 can be fitted in the same fitting conditions between the left ear 100 and the right ear 100, thereby improving the ease-of-use of the audio output apparatus 1.

Furthermore, the audio output apparatus 1 for the left ear 100 and the audio output apparatus 1 for the right ear 100 can be used interchangeably, thereby improving the general-purpose properties of the audio output apparatus 1.

However, the audio output apparatus 1 may be configured such that the rotating body 3 is rotatable in only one direction relative to the base body 2. In this case, the audio output apparatus 1 for the left ear 100 and the audio output apparatus 1 for the right ear 100 are identified in advance, and the audio output apparatus 1 for the left ear 100 is fitted in the left ear 100 by rotating the rotating body 3 in one direction relative to the base body 2, whereas the audio output apparatus 1 for the right ear 100 is fitted in the right ear 100 by rotating the rotating body 3 in the other direction relative to the base body 2.

<Other Examples of Audio Output Apparatus>

Figure 21:
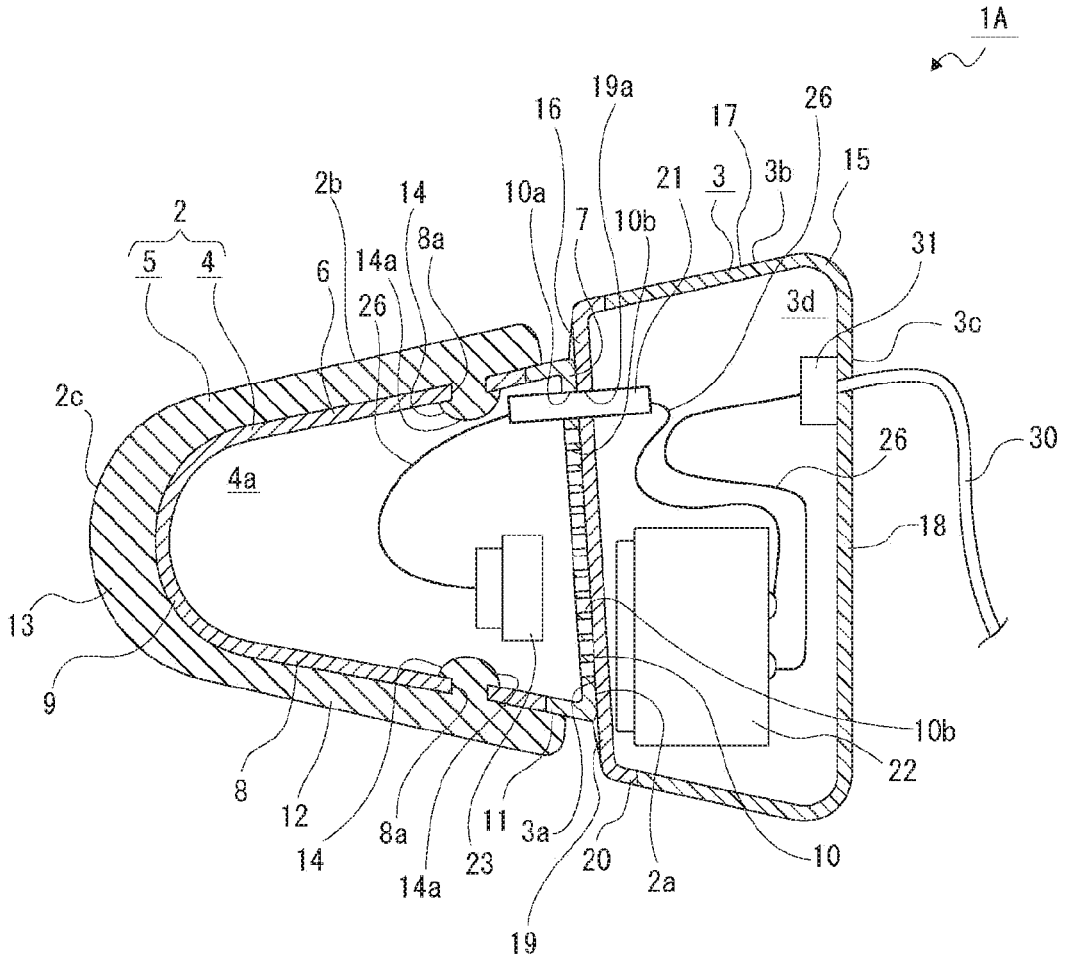
FIG. 21 is a cross-sectional view showing an example of the audio output apparatus to which a cable is connected.
Figure 22:
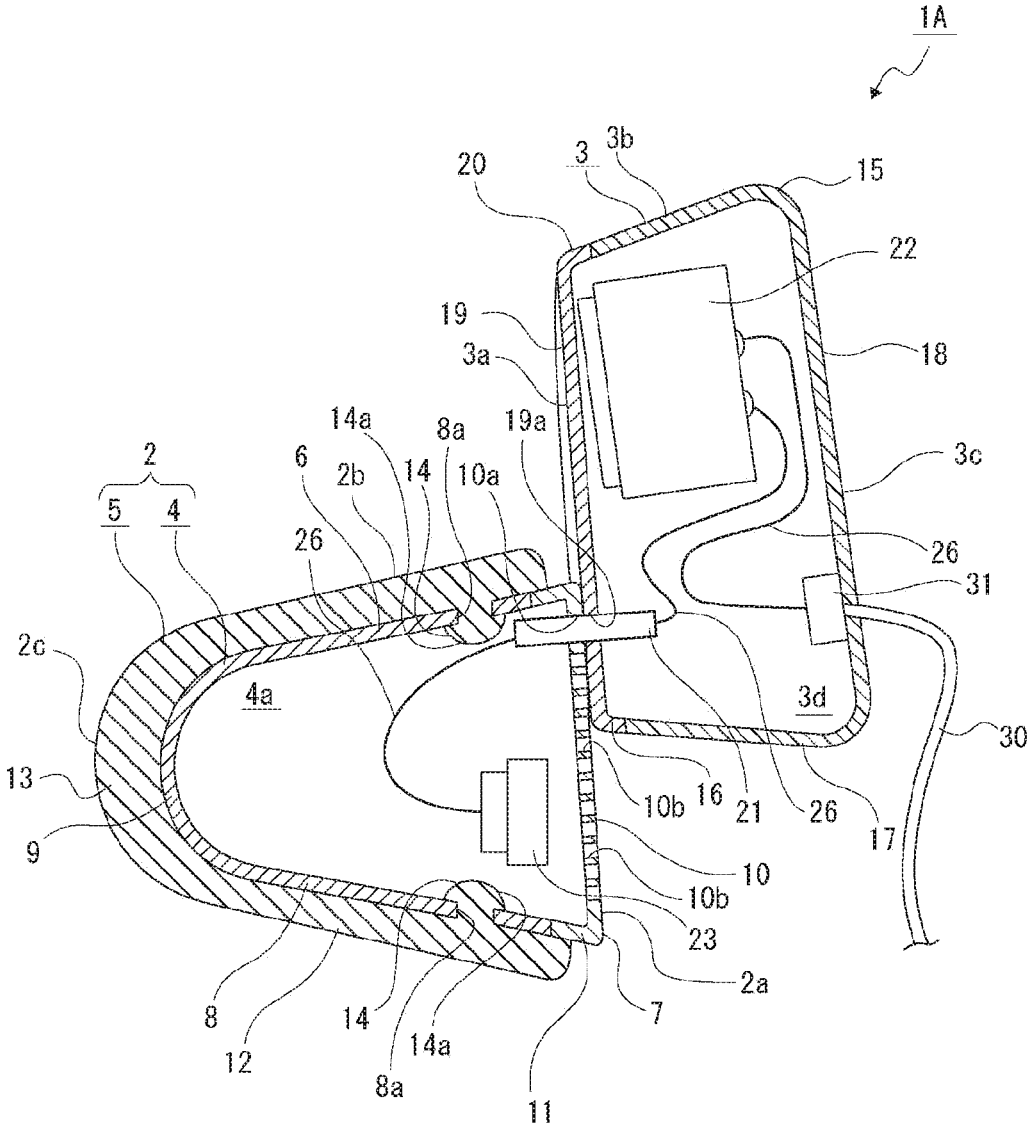
FIG. 22 is a diagram illustrating a state where the rotating body is rotated relative to the base body in the audio output apparatus to which a cable is connected.

The foregoing has described the audio output apparatus 1 that includes the antenna by way of example. However, instead of the audio output apparatus 1, an audio output apparatus 1A having a configuration in which, for example, no antenna is disposed can be used (see FIGS. 21 and 22).

A cable 30 is connected to the audio output apparatus 1A and, via the cable 30, power is supplied to, and signals are transmitted to and from, the audio output apparatus 1A. In the audio output apparatus 1A, for example, the microphone 23 is placed inside the base body 2, the speaker 22 and a terminal portion 31 are placed inside the rotating body 3, and the cable 30 is connected to the terminal portion 31. The terminal portion 31 and the speaker 22, and the speaker 22 and the microphone 23 are connected by connection lines 26 and 26, respectively.

Note that, in the audio output apparatus 1A, both the speaker 22 and the microphone 23 may be placed inside the base body 2, or both the speaker 22 and the microphone 23 may be placed inside the rotating body 3.

Since power is supplied to, and signals are transmitted to and from, the audio output apparatus 1A via the cable 30, the battery and the control board may not necessarily be disposed inside. Therefore, the audio output apparatus 1A achieves reduction in the number of components and a simpler structure, and furthermore, the size of the audio output apparatus 1A can be reduced because the placement spaces disposed inside the base body 2 and the rotating body 3 can be made smaller.

In addition, in the case of a configuration in which the cable 30 is bifurcated into two ends connected to the audio output apparatuses 1A, 1A for the left ear 100 and the right ear 100, respectively, the audio output apparatus 1A for the left ear 100 and the audio output apparatus 1A for the right ear 100 are connected via the cable 30, and therefore, loss of the audio output apparatuses 1A, 1A can be reduced.

<Examples of Orientations of Facing Surface, Relative Surface, and Fulcrum Shaft in Audio Output Apparatus>

The foregoing has described examples of the audio output apparatus 1 in which the facing surface 2*a* and the relative surface 3*a* are inclined with respect to the central axes P and Q, respectively, and the axial direction of the fulcrum shaft 21 is orthogonal to the facing surface 2*a* and to the relative surface 3*a*. However, the facing surface 2*a*, the relative surface 3*a*, and the axial direction of the fulcrum shaft 21 may be oriented as described below (see FIGS. 23 to 30).

Figure 23:
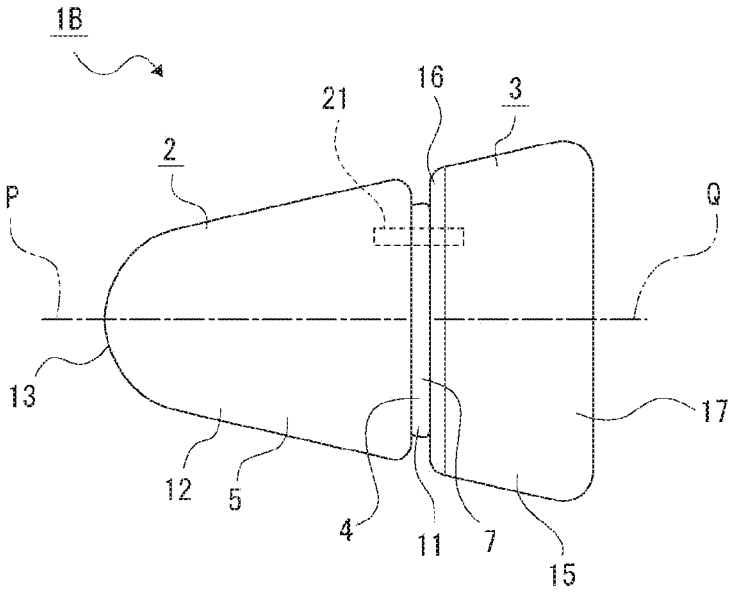
FIG. 23 shows, along with FIGS. 24 to 30, examples of the audio output apparatus having a facing surface and a fulcrum shaft disposed in different orientations.
Figure 24:
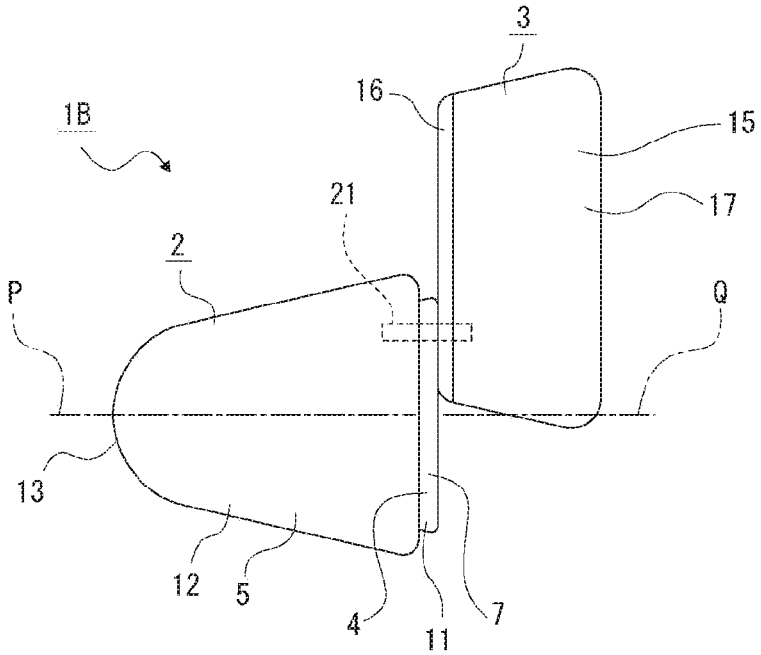
FIG. 24 is a front view showing a state where the rotating body is rotated relative to the base body in an example in which the facing surface is orthogonal to the central axis and the axial direction of the fulcrum shaft is orthogonal to the facing surface.

For example, an audio output apparatus 1B can be configured such that the facing surface 2*a* and the relative surface 3*a* are orthogonal to the central axes P and Q, and that the axial direction of the fulcrum shaft 21 is orthogonal to the facing surface 2*a* and to the relative surface 3*a* (see FIGS. 23 and 24).

In the audio output apparatus 1B, the facing surface 2*a* and the relative surface 3*a* are along a direction orthogonal to the central axes P and Q. Therefore, the placement space 4*a* in the base body 2 and the component placement space 3*d* in the rotating body 3 are in a simpler shape, the individual units can be placed in the placement space 4*a* and the component placement space 3*d* more flexibly, and the audio output apparatus 1B has a higher degree of flexibility in design and can be made smaller in size.

Figure 25:
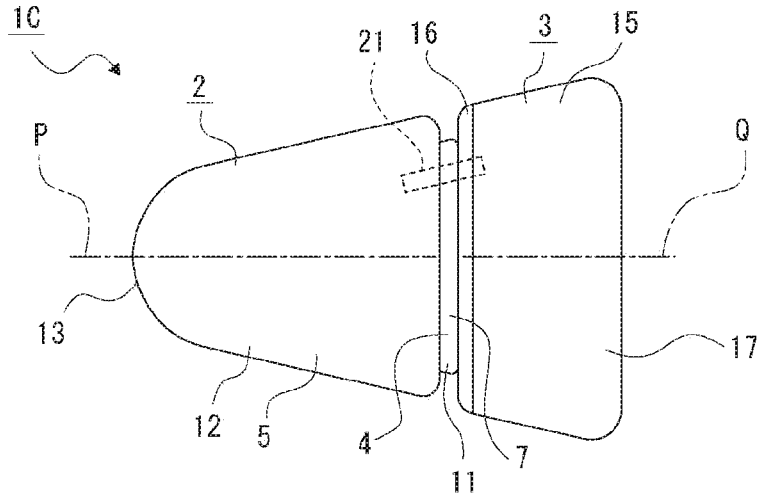
FIG. 25 is a front view showing an example in which the facing surface is orthogonal to the central axis and the axial direction of the fulcrum shaft is inclined with respect to the central axis.
Figure 26:
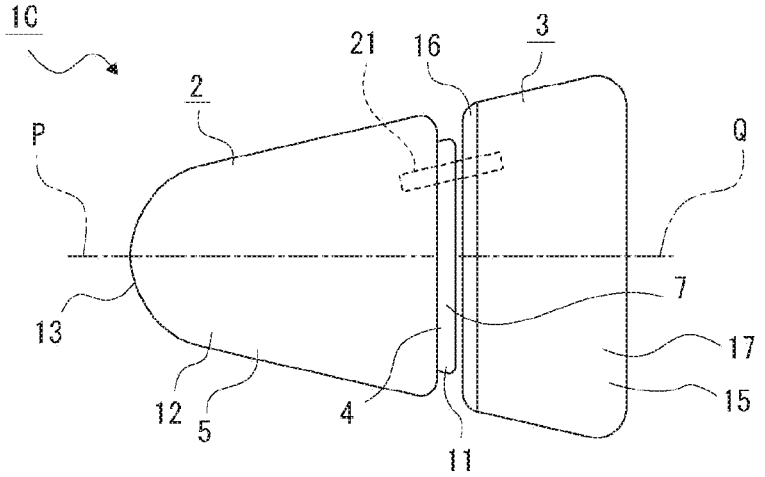
FIG. 26 is a front view showing a state where the rotating body is spaced away from the base body in an example in which the facing surface is orthogonal to the central axis and the axial direction of the fulcrum shaft is inclined with respect to the central axis.
Figure 27:
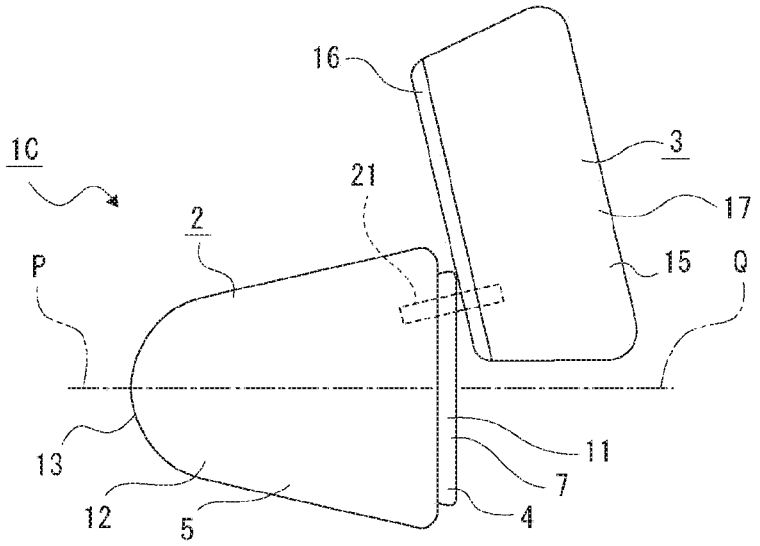
FIG. 27 is a front view showing a state where the rotating body is rotated relative to the base body in an example in which the facing surface is orthogonal to the central axis and the axial direction of the fulcrum shaft is inclined with respect to the central axis.

Alternatively, for example, an audio output apparatus 1C can be configured such that the facing surface 2*a* and the relative surface 3*a* are orthogonal to the central axes P and Q, and that the axial direction of the fulcrum shaft 21 is inclined with respect to the central axes P and Q (see FIGS. 25 to 27).

In the audio output apparatus 1C, the length of the fulcrum shaft 21 along the axial direction is variable. Rotation of the rotating body 3 relative to the base body 2 is started in a state where the fulcrum shaft 21 in the non-rotation state is elongated and the rotating body 3 is spaced away from the base body 2 in the axial direction of the fulcrum shaft 21 (see FIGS. 26 and 27).

In the audio output apparatus 1C, since the length of the fulcrum shaft 21 along the axial direction is made variable, the distance between the base body 2 and the rotating body 3 can be changed by changing the length of the fulcrum shaft 21. Therefore, the rotating body 3 can be rotated smoothly relative to the base body 2.

Figure 28:
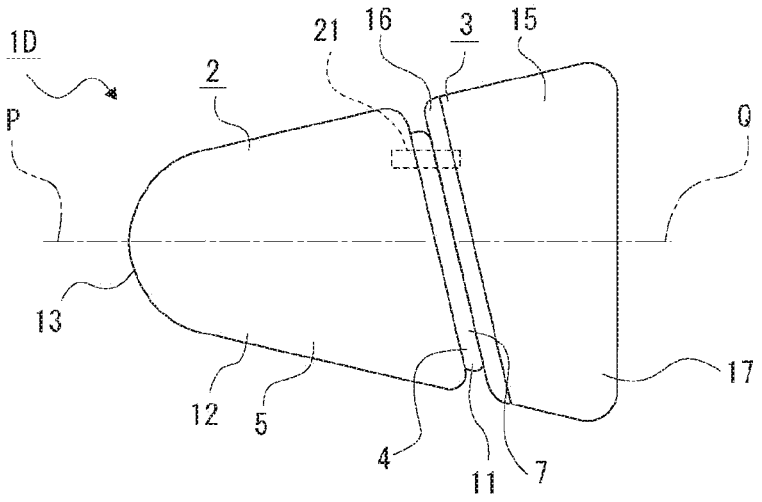
FIG. 28 is a front view showing an example in which the facing surface is inclined with respect to the central axis and the axial direction of the fulcrum shaft coincides with the central axis.
Figure 29:
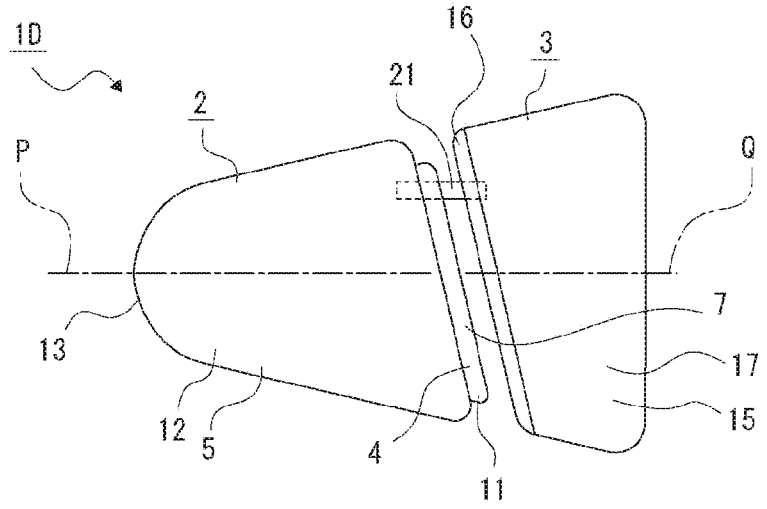
FIG. 29 is a front view showing a state where the rotating body is spaced away from the base body in an example in which the facing surface is inclined with respect to the central axis and the axial direction of the fulcrum shaft coincides with the central axis.
Figure 30:
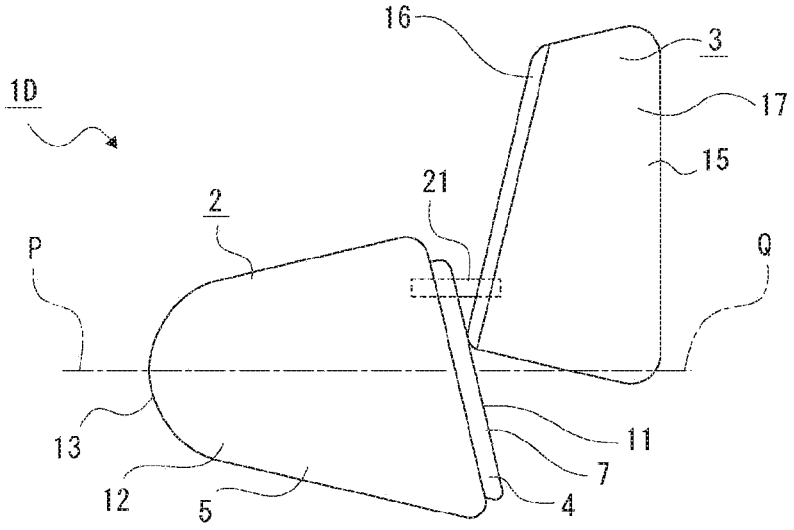
FIG. 30 is a front view showing a state where the rotating body is rotated relative to the base body in an example in which the facing surface is inclined with respect to the central axis and the axial direction of the fulcrum shaft coincides with the central axis.

In addition, for example, an audio output apparatus 1D can be configured such that the facing surface 2*a* and the relative surface 3*a* are inclined with respect to the central axes P and Q, and that the axial direction of the fulcrum shaft 21 is along the direction of the central axes P and Q (see FIGS. 28 to 30).

In the audio output apparatus 1D, the length of the fulcrum shaft 21 along the axial direction is variable. Rotation of the rotating body 3 relative to the base body 2 is started in a state where the fulcrum shaft 21 in the non-rotation state is elongated and the rotating body 3 is spaced away from the base body 2 in the axial direction of the fulcrum shaft 21 (see FIGS. 29 and 30).

In the audio output apparatus 1D, since the length of the fulcrum shaft 21 along the axial direction is made variable, the distance between the base body 2 and the rotating body 3 can be changed by changing the length of the fulcrum shaft 21. Therefore, the rotating body 3 can be rotated smoothly relative to the base body 2.

Furthermore, the rotating body 3 can be rotated relative to the base body 2 without regard to the inclination angles of the facing surface 2*a* and the relative surface 3*a* with respect to the central axes P and Q, thereby improving the flexibility in design.

Note that according to examples of the audio output apparatuses 1C and 1D described above, the length of the fulcrum shaft 21 along the axial direction is variable, and the rotating body 3 is spaced away from the base body 2 in the axial direction of the fulcrum shaft 21; however, another configuration may be possible in which the length of the fulcrum shaft 21 along the axial direction is fixed, and the rotating body 3 is moved from the fulcrum shaft 21 in the axial direction of the fulcrum shaft 21 so that the rotating body 3 is spaced away from the base body 2 in the axial direction of the fulcrum shaft 21.

<Others>

The foregoing has described examples in which the fulcrum shaft 21 is at a position (eccentric position) displaced from a middle portion (central portion) of the facing surface 2*a* and from a middle portion (central portion) of the relative surface 3*a*. However, the fulcrum shaft 21 may be at a position displaced from either one of the middle portion of the facing surface 2*a* and the middle portion of the relative surface 3*a* (see FIGS. 31 to 34).

Figure 31:
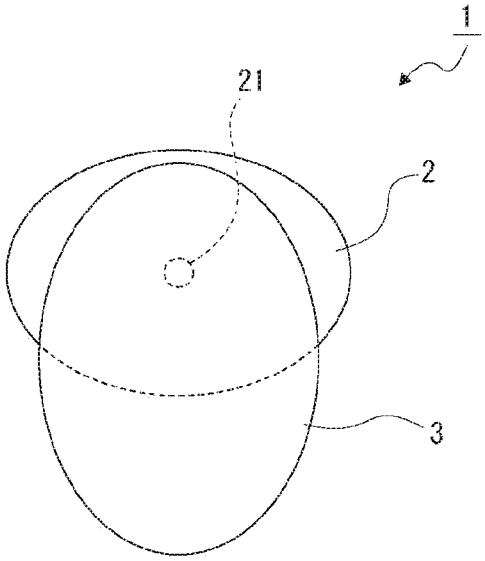
FIG. 31 is a side view showing an example of the audio output apparatus in which the fulcrum shaft is located in a middle portion of the facing surface.
Figure 32:
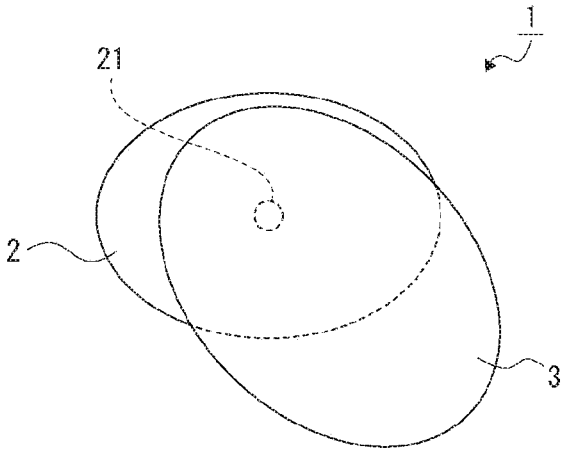
FIG. 32 is a side view showing a state where the rotating body is rotated relative to the base body in an example of the audio output apparatus in which the fulcrum shaft is located in a middle portion of the facing surface.

For example, there may be a configuration in which the fulcrum shaft 21 is at the middle portion of the facing surface 2*a* but is out of the middle portion of the relative surface 3*a* (see FIGS. 31 and 32). The base body 2 and the rotating body 3 may be in any shape. For example, the facing surface 2*a* may be formed in a non-circular shape such as an oval shape and the relative surface 3*a* (bottom surface 3*c*) may be formed in a non-circular shape such as an oval shape, whereby the rotating body 3 protrudes from the base body 2 by a varying amount and at a varying position as the rotating body 3 is gradually rotated relative to the base body 2 so that the rotating body 3 can be brought into contact with part of the ear 100.

Figure 33:
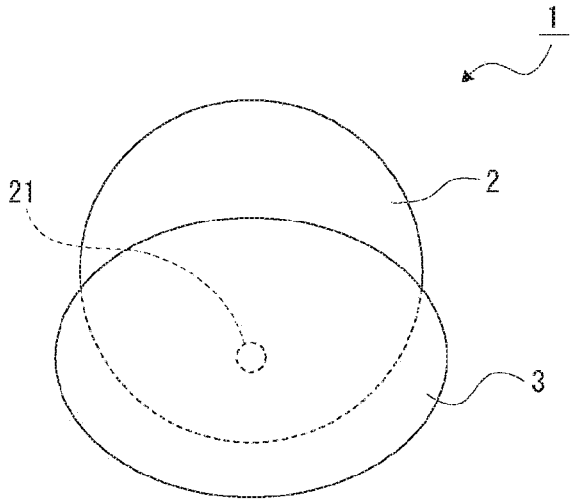
FIG. 33 is a side view showing an example of the audio output apparatus in which the fulcrum shaft is located in a middle portion of the relative surface.
Figure 34:
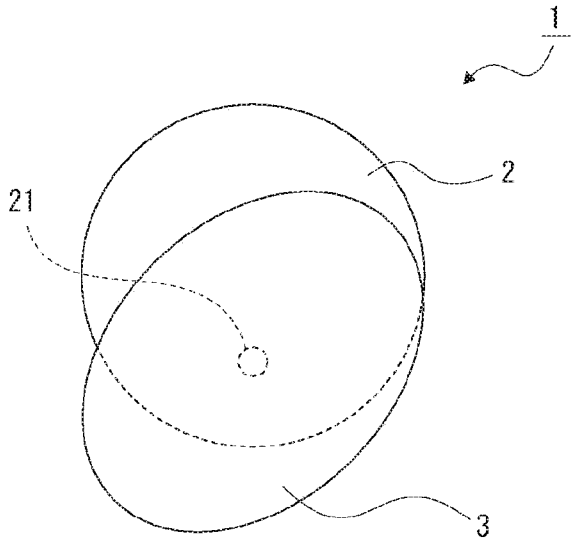
FIG. 34 is a side view showing a state where the rotating body is rotated relative to the base body in an example of the audio output apparatus in which the fulcrum shaft is located in a middle portion of the relative surface.
Figure 35:
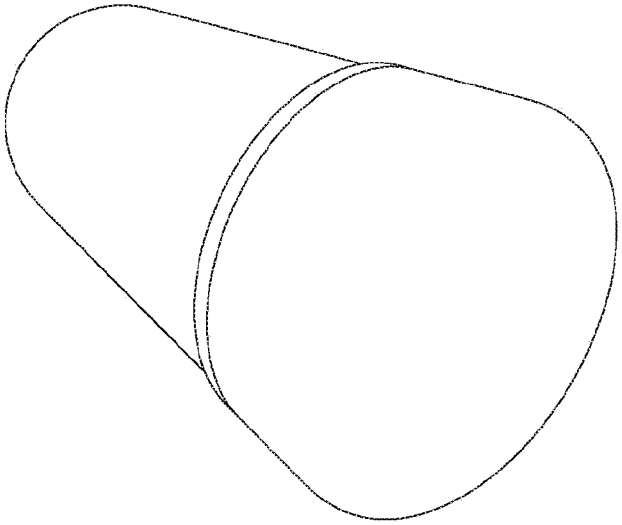
FIG. 35 is a perspective view of the audio output apparatus.
Figure 36:
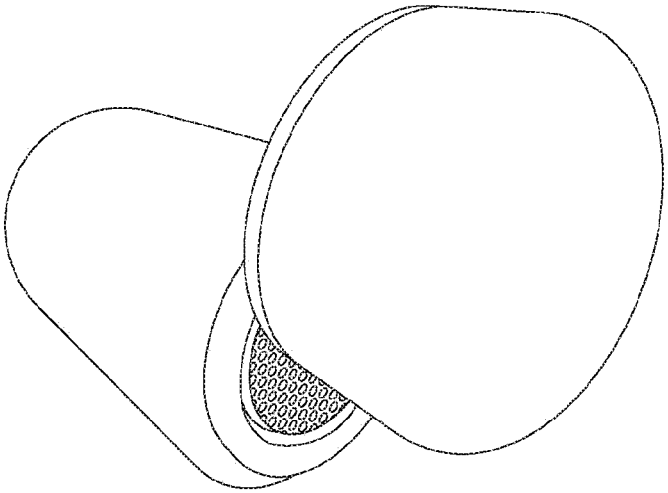
FIG. 36 is a perspective view of the audio output apparatus in a state where the rotating body is rotated relative to the base body.
Figure 37:
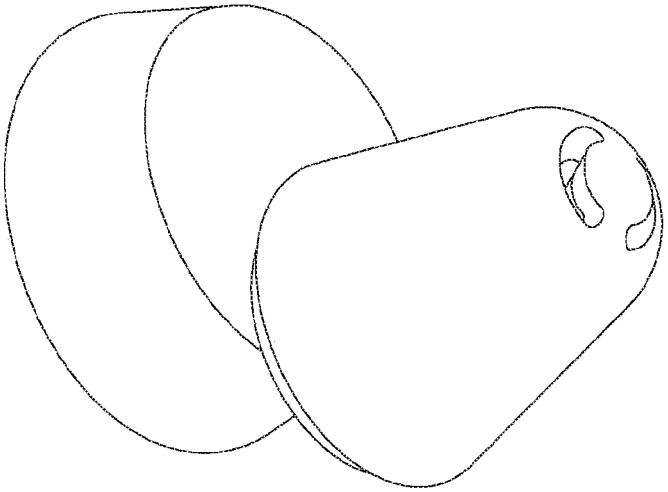
FIG. 37 is a perspective view of the audio output apparatus in a state where the rotating body is rotated relative to the base body, as seen from a direction different from the direction in FIG. 36.
Figure 38:
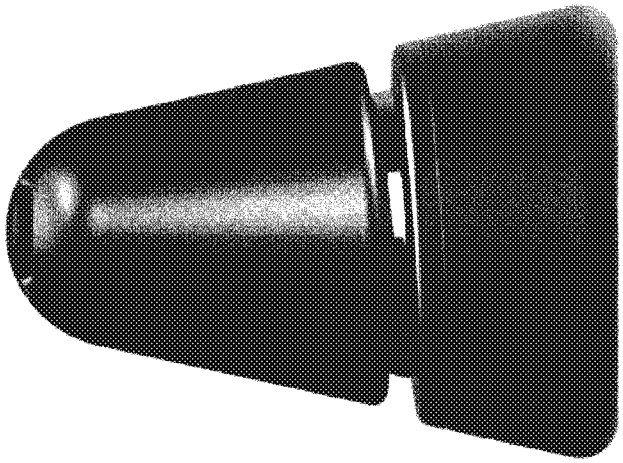
FIG. 38 is a front view of the audio output apparatus.
Figure 39:
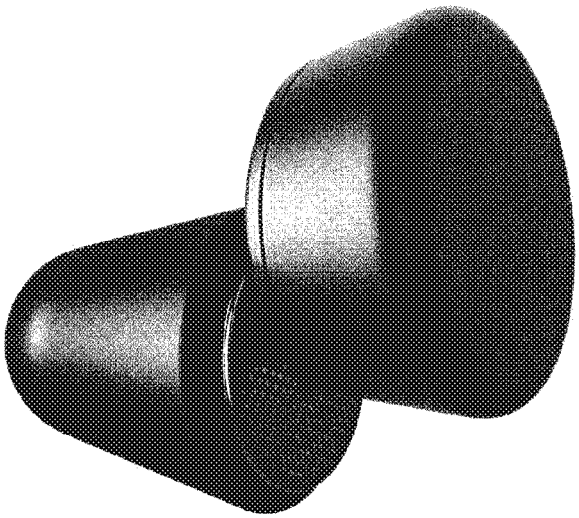
FIG. 39 is a perspective view of the audio output apparatus in a state where the rotating body is rotated relative to the base body.

Furthermore, for example, there may be a configuration in which the fulcrum shaft 21 is at the middle portion of the relative surface 3*a* but is out of the middle portion of the facing surface 2*a* (see FIGS. 33 and 34). The base body 2 and the rotating body 3 may be in any shape. For example, the facing surface 2*a* may be formed in a circular shape and the relative surface 3*a* (bottom surface 3*c*) may be formed in a non-circular shape such as an oval shape, whereby the rotating body 3 protrudes from the base body 2 by a varying amount and at a varying position as the rotating body 3 is gradually rotated relative to the base body 2 so that the rotating body 3 can be brought into contact with part of the ear 100.

FIGS. 35 to 39 show the audio output apparatus 1 in different orientations.

<Present Technology>

The present technology can be configured as follows.

(1)

An audio output apparatus including:

a speaker that outputs a sound;

a base body that includes a facing surface and is at least partially inserted into an ear canal of an ear;

a rotating body that includes a relative surface at least partially facing the facing surface and is rotatable relative to the base body; and a fulcrum shaft that is present at least at one of a position displaced from a middle portion of the facing surface or a position displaced from a middle portion of the relative surface, the fulcrum shaft serving as a fulcrum of rotation of the rotating body relative to the base body, in which in a state where the base body is inserted into the ear canal, the rotating body rotated relative to the base body is allowed to be in contact with part of the ear.

(2)

The audio output apparatus according to (1), in which the rotating body rotated relative to the base body is at least partially inserted into a cavity of concha.

(3)

The audio output apparatus according to (1) or (2), in which the rotating body rotated relative to the base body is at least partially brought into contact with an antihelix or an inferior crus of antihelix.

(4)

The audio output apparatus according to any one of (1) to (3), in which the base body includes an outer circumferential surface that is a surface of revolution formed by being rotated with respect to a central axis, the facing surface and the relative surface are inclined with respect to a plane orthogonal to the central axis, and an axial direction of the fulcrum shaft is along a direction orthogonal to the facing surface.

(5)

The audio output apparatus according to any one of (1) to (4), in which the facing surface and the relative surface are in surface contact with each other.

(6)

The audio output apparatus according to any one of (1) to (5), in which a microphone is placed inside the base body, and a sound input hole intended for inputting a sound to the microphone is formed in a portion in the base body, the portion facing the relative surface.

(7)

The audio output apparatus according to any one of (1) to (6), in which the rotating body includes a circumferential surface whose one end is continuous with an outer periphery of the relative surface, and the circumferential surface is formed into a curved surface.

(8)

The audio output apparatus according to any one of (1) to (7), in which the base body is formed in a tapered shape whose outer circumference becomes smaller as the base body is farther away from the rotating body.

(9)

The audio output apparatus according to (8), in which the base body is formed in a substantially conical shape.

(10)

The audio output apparatus according to (8) or (9), in which an outer surface of a tip side portion of the base body is formed in a curved shape convex toward the tip side.

(11)

The audio output apparatus according to any one of (1) to (10), in which the base body includes an enclosure and an earpiece, the enclosure including a placement space that is formed inside the enclosure, the earpiece being in close contact with at least part of an outer surface of the enclosure, and the earpiece includes an elastically deformable material.

(12)

The audio output apparatus according to (11), in which the earpiece includes a tip portion and an outer circumferential portion, the tip portion including a sound output hole that is formed in the earpiece, the outer circumferential portion being continuous with the tip portion and being formed to be tubular, and a thickness of the tip portion is greater than the thickness of the outer circumferential portion.

(13)

The audio output apparatus according to any one of (1) to (12), in which the rotating body is rotatable relative to the base body in opposite directions.

(14)

The audio output apparatus according to any one of (1) to (13), in which a battery being substantially cylindrical and a control board to which power is supplied from the battery are placed inside the rotating body, and an axial direction of the battery and an orientation of the control board coincide with a direction along which the base body and the rotating body are arranged.

(15)

The audio output apparatus according to (14), in which the battery and the control board are positioned to face each other.

(16)

The audio output apparatus according to any one of (1) to (15), in which an antenna that transmits and receives a signal is disposed.

(17)

The audio output apparatus according to any one of (1) to (16), in which a connection line that is partially positioned inside the base body and partially positioned inside the rotating body and is configured to supply at least power is disposed, the fulcrum shaft is formed to be tubular, and the connection line is partially inserted through the fulcrum shaft.

(18)

The audio output apparatus according to any one of (1) to (17), in which a length of the fulcrum shaft along an axial direction is variable.

REFERENCE SIGNS LIST

100 Ear
105 Antihelix
107 Inferior crus of antihelix
113 Ear canal
114 Cavity of concha
115 Incisura intertragica
1 Audio output apparatus
2 Base body
2*a* Facing surface
2*b* Outer circumferential surface
3 Rotating body
3*a* Relative surface
3*b* Circumferential surface
4 Enclosure
4*a* Placement space
5 Earpiece
10*b* Sound input hole
12 Outer circumferential portion
13 Tip portion
21 Fulcrum shaft
22 Speaker
23 Microphone
24 Battery
25 Control board
26 Connection line
1A Audio output apparatus
1B Audio output apparatus
1C Audio output apparatus
1D Audio output apparatus

The invention claimed is:

1. An audio output apparatus comprising:

a speaker that outputs a sound;

a base body that includes a facing surface and is at least partially inserted into an ear canal of an ear;

a rotating body that includes a relative surface at least partially facing the facing surface and is rotatable relative to the base body; and a fulcrum shaft that is present at least at one of a position displaced from a middle portion of the facing surface or a position displaced from a middle portion of the relative surface, the fulcrum shaft serving as a fulcrum of rotation of the rotating body relative to the base body, in which in a state where the base body is inserted into the ear canal, the rotating body rotated relative to the base body is allowed to be in contact with part of the ear.

2. The audio output apparatus according to claim 1, wherein the rotating body rotated relative to the base body is at least partially inserted into a cavity of concha.

3. The audio output apparatus according to claim 1, wherein the rotating body rotated relative to the base body is at least partially brought into contact with an antihelix or an inferior crus of antihelix.

4. The audio output apparatus according to claim 1, wherein the base body includes an outer circumferential surface that is a surface of revolution formed by being rotated with respect to a central axis, the facing surface and the relative surface are inclined with respect to a plane orthogonal to the central axis, and an axial direction of the fulcrum shaft is along a direction orthogonal to the facing surface.

5. The audio output apparatus according to claim 1, wherein the facing surface and the relative surface are in surface contact with each other.

6. The audio output apparatus according to claim 1, wherein a microphone is placed inside the base body, and a sound input hole intended for inputting a sound to the microphone is formed in a portion in the base body, the portion facing the relative surface.

7. The audio output apparatus according to claim 1, wherein the rotating body includes a circumferential surface whose one end is continuous with an outer periphery of the relative surface, and the circumferential surface is formed into a curved surface.

8. The audio output apparatus according to claim 1, wherein the base body is formed in a tapered shape whose outer circumference becomes smaller as the base body is farther away from the rotating body.

9. The audio output apparatus according to claim 8, wherein the base body is formed in a substantially conical shape.

10. The audio output apparatus according to claim 8, wherein an outer surface of a tip side portion of the base body is formed in a curved shape convex toward the tip side.

11. The audio output apparatus according to claim 1, wherein the base body includes an enclosure and an earpiece, the enclosure including a placement space that is formed inside the enclosure, the earpiece being in close contact with at least part of an outer surface of the enclosure, and the earpiece includes an elastically deformable material.

12. The audio output apparatus according to claim 11, wherein the earpiece includes a tip portion and an outer circumferential portion, the tip portion including a sound output hole that is formed in the earpiece, the outer circumferential portion being continuous with the tip portion and being formed to be tubular, and a thickness of the tip portion is greater than the thickness of the outer circumferential portion.

13. The audio output apparatus according to claim 1, wherein the rotating body is rotatable relative to the base body in opposite directions.

14. The audio output apparatus according to claim 1, wherein a battery being substantially cylindrical and a control board to which power is supplied from the battery are placed inside the rotating body, and an axial direction of the battery and an orientation of the control board coincide with a direction along which the base body and the rotating body are arranged.

15. The audio output apparatus according to claim 14, wherein the battery and the control board are positioned to face each other.

16. The audio output apparatus according to claim 1, wherein an antenna that transmits and receives a signal is disposed.

17. The audio output apparatus according to claim 1, wherein a connection line that is partially positioned inside the base body and partially positioned inside the rotating body and is configured to supply at least power is disposed, the fulcrum shaft is formed to be tubular, and the connection line is partially inserted through the fulcrum shaft.

18. The audio output apparatus according to claim 1, wherein a length of the fulcrum shaft along an axial direction is variable.

* * * * *